US008351831B2

(12) United States Patent
Hori et al.

(10) Patent No.: US 8,351,831 B2
(45) **Date of Patent: *Jan. 8, 2013**

(54) DISPLACEMENT CORRECTING DEVICE, INTERMEDIATE TRANSFER DEVICE, TRANSFER DEVICE, AND IMAGE FORMING APPARATUS

(75) Inventors: Satoru Hori, Saitama (JP); Naohisa Fujita, Saitama (JP)

(73) Assignee: Fuji Xerox Co., Ltd., Seoul (KR)

( * ) Notice: Subject to any disclaimer, the term of this patent is extended or adjusted under 35 U.S.C. 154(b) by 355 days.

This patent is subject to a terminal disclaimer.

(21) Appl. No.: 12/575,035

(22) Filed: Oct. 7, 2009

(65) Prior Publication Data

US 2010/0247174 A1 Sep. 30, 2010

(30) Foreign Application Priority Data

Mar. 27, 2009 (JP) ..... P2009-080668
Mar. 27, 2009 (JP) ..... P2009-080669

(51) Int. Cl.
*G03G 15/01* (2006.01)

(52) U.S. Cl. ..... 399/303; 399/165; 399/302; 198/806; 198/807; 198/810; 271/275; 474/108

(58) Field of Classification Search ..... 399/165, 399/302, 303; 474/108; 198/806, 807, 810.01; 271/275

See application file for complete search history.

(56) References Cited

U.S. PATENT DOCUMENTS 5,181,888 A 1/1993 Takahashi et al.
5,964,339 A * 10/1999 Matsuura et al. ..... 198/810.03
6,141,525 A * 10/2000 Tahara ..... 399/395
6,249,661 B1 6/2001 Saitoh et al.
7,806,253 B2 * 10/2010 Graswinckel et al. ..... 198/806
7,815,042 B2 * 10/2010 Oishi ..... 198/837
2006/0119029 A1 6/2006 Kitamura (Continued)

FOREIGN PATENT DOCUMENTS

JP 4-133930 5/1992

(Continued)

OTHER PUBLICATIONS

Japanese Office Action dated Mar. 8, 2011 from the Japanese Patent Office in a counterpart Japanese application.

(Continued)

*Primary Examiner* — David Gray
*Assistant Examiner* — Francis Gray
(74) *Attorney, Agent, or Firm* — Morgan, Lewis & Bockius LLP

(57) ABSTRACT

An displacement correcting device is provided and includes: a rotation supporting member having a rotation shaft and rotating to support the endless belt-shaped member; a shaft supporting frame supporting a one-end supporting portion of the rotation shaft movably relative to an opposite-end supporting portion and supporting one end of the rotation shaft to be tilted about the other end; and a shaft displacing member having a rotation center disposed closer to one end portion in the axial direction than a rotation shaft supporting body and intersected by the axial direction and a rotation shaft contact portion contacting with the one end of the rotation shaft. The shaft displacing member allows the rotation shaft contact portion to rotate about the rotation center to tilt the rotation shaft when a movement sensing member detects the movement of the endless belt-shaped member to the one end of the rotation shaft.

15 Claims, 16 Drawing Sheets

U.S. PATENT DOCUMENTS

| | | | | |
|---|---|---|---|---|
| 2006/0216056 | A1* | 9/2006 | Okabe | 399/101 |
| 2007/0110471 | A1 | 5/2007 | Kitamura | |
| 2007/0231021 | A1* | 10/2007 | Kinoshita et al. | 399/301 |
| 2009/0245836 | A1* | 10/2009 | Sato | 399/68 |
| 2010/0247170 | A1* | 9/2010 | Nakamura et al. | 399/302 |
| 2010/0247174 | A1 | 9/2010 | Hori et al. | |

FOREIGN PATENT DOCUMENTS

| | | | |
|---|---|---|---|
| JP | 6-99055 | | 12/1994 |
| JP | 6-99055 | B | 12/1994 |
| JP | 8-320634 | | 12/1996 |
| JP | 2001-080782 | | 3/2001 |
| JP | 2001-80782 | A | 3/2001 |
| JP | 2003-148446 | A | 5/2003 |
| JP | 2006-162659 | | 6/2006 |
| JP | 2006-162659 | A | 6/2006 |
| JP | 2007-139921 | A | 6/2007 |
| JP | 2008-40397 | A | 2/2008 |
| JP | 2008-70706 | A | 3/2008 |
| JP | 2008-129494 | A | 6/2008 |
| JP | 2009-181107 | | 8/2009 |
| JP | 2009-181107 | A | 8/2009 |
| JP | 2009-210702 | A | 9/2009 |
| JP | 2009-258494 | | 11/2009 |
| JP | 2009-258494 | A | 11/2009 |

OTHER PUBLICATIONS

Notice of Allowance dated Dec. 22, 2011 from U.S. PTO in counterpart U.S. Appl. No. 12/557,162.

* cited by examiner

DISPLACEMENT CORRECTING DEVICE, INTERMEDIATE TRANSFER DEVICE, TRANSFER DEVICE, AND IMAGE FORMING APPARATUS

CROSS-REFERENCE TO RELATED APPLICATION

This application is based on and claims priority under 35 USC §119 from Japanese Patent Application Nos. 2009-080668 and 2009-080669, both filed Mar. 27, 2009.

BACKGROUND (i) Technical Field

The present invention relates to a displacement correcting device, an intermediate transfer device, a transfer device, and an image forming apparatus.

(ii) Related Art

Techniques of conveying a medium or the like using an endless belt-shaped conveyer in image forming apparatuses such as electrophotographic copiers and printers are known. In image forming apparatuses, know is a technique of correcting the meandering of an endless belt-shaped member such as the conveyer belt which occurs when a degree of parallelism of suspension members suspending the endless belt-shaped member from the rear surface thereof is low, that is, when the axial directions of the suspension members are displaced from the parallel.

SUMMARY

According to an aspect of the invention, there is provided an displacement correcting device comprising:

an endless belt-shaped member;

a rotation supporting member that includes a rotation shaft the axial direction of which is parallel to a width direction of the endless belt-shaped member and rotates to support the endless belt-shaped member;

a rotation shaft supporting body that includes a one-end supporting portion rotatably supporting one end of the rotation shaft and an opposite-end supporting portion rotatably supporting the other end of the rotation shaft;

a shaft supporting frame that supports the one-end supporting portion movably relative to the opposite-end supporting portion and supports the one end of the rotation shaft so that the one end of the rotation shaft can be tilted with respect to the other end of the rotation shaft;

a movement detecting member that detects movement of the endless belt-shaped member to the one end of the rotation shaft; and a shaft displacing member that includes a rotation center which is disposed at a position displaced from the rotation shaft and closer to the one end of the rotation shaft than the rotation shaft supporting body and which intersects an axial direction of the rotation shaft, and that further includes a rotation shaft contact portion which contacts with the one end of the rotation shaft, wherein the movement detecting member detects the movement of the endless belt-shaped member to the one end of the rotation shaft, the rotation shaft contact portion rotates about the rotation center to move the one end of the rotation shaft relative to the other end of the rotation shaft so that the rotation shaft is tilted in a tilt direction in which the endless belt-shaped member moves to the other end of the rotation shaft.

BRIEF DESCRIPTION OF THE DRAWINGS

Exemplary embodiments of the present invention will be described in detail based on the following figures, wherein:

FIG. 6A is a perspective view of the belt module in a state where a front plate of a belt supporting frame and a medium conveying belt are detached from the belt module, FIG. 6B is a partially enlarged view of a longitudinal hole for adjusting the position of a pressing member, and FIG. 6C is a diagram illustrating a pin pressing mechanism;

FIG. 10A is an enlarged perspective view from a front end of a driven roller to a front bearing and FIG. 10B is a sectional view taken along line XB-XB of FIG. 10A;

FIG. 11A is an enlarged view as viewed in the direction of arrow XIA in FIG. 10A, FIG. 11B is an enlarged view as viewed in the direction of arrow XIB in FIG. 11A, FIG. 11C is an enlarged perspective view as viewed in the direction of arrow XIC in FIG. 11B, and FIG. 11D is an enlarged perspective view as viewed in the direction of arrow XID in FIG. 11C;

FIG. 13A is a perspective sectional view from a front end of a driven roller to a front bearing, which corresponds to FIG. 10A of Embodiment 1, and FIG. 13B is a diagram illustrating a swing bracket as viewed in the direction of arrow XIIIB of FIG. 13A;

FIG. 14A is perspective sectional view from a front end of a driven roller to a front bearing, which corresponds to FIG. 13A of Embodiment 2, and FIG. 14B is a partially enlarged view of the belt displacement detecting member and the shaft displacing member as viewed in the direction of arrow XIVB of FIG. 14A;

FIG. 16A is a perspective enlarged view from a front end of a driven roller to a front bearing and FIG. 16B is a sectional view taken along line XVIB-XVIB of FIG. 16A.

DETAILED DESCRIPTION

Figure 1:
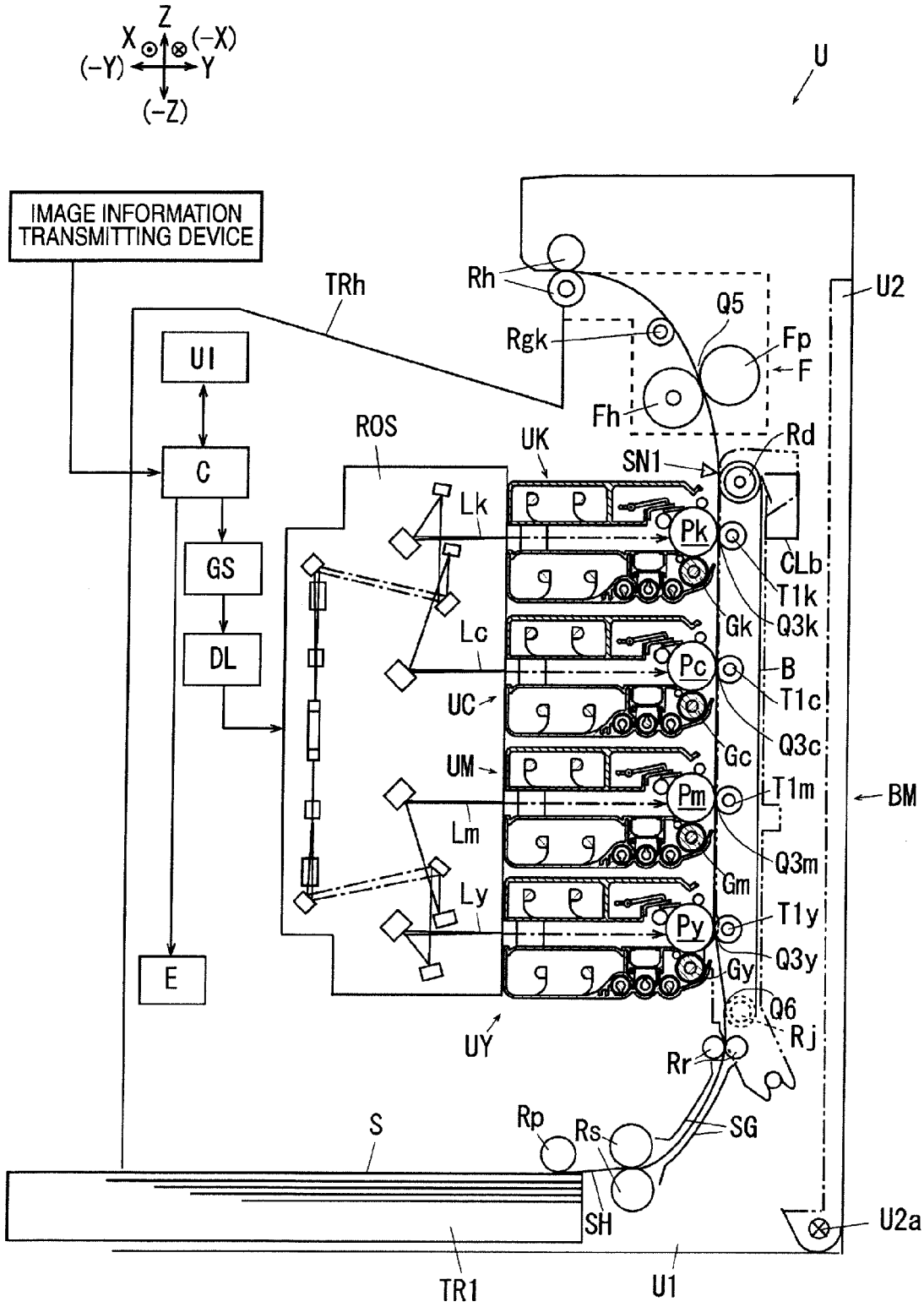
FIG. 1 is a diagram illustrating the entire configuration of an image forming apparatus according to Embodiment 1 of the invention.

Exemplary embodiments (hereinafter, referred to as "embodiment") of the invention will be described with reference to the accompanying drawings, but the invention is not limited to the examples.

For the purpose of easy understanding of the following description, in the drawings, the front and rear directions are an X axis direction, the left and right directions are a Y axis direction, the upward and downward directions are a Z axis direction, the directions or the sides indicated by arrows X, -X, Y, -Y, Z, and -Z are respectively the front direction, the rear direction, the right direction, the left direction, the upward direction, and the downward direction, or the front side, the rear side, the right side, the left side, the up side, and the down side.

In the drawings, the symbol in which "•" is marked in "O" means an arrow from the back side of the paper surface to the front side and the symbol in which "X" is marked in "O" means an arrow from the front side of the paper surface to the back side.

In the following description with reference to the drawings, elements other than elements of which the explanation is necessary for the purpose of easy understanding are properly not shown.

Embodiment 1

FIG. 1 is a diagram illustrating the entire configuration of an image forming apparatus according to Embodiment 1 of the invention.

In a printer U as an example of the image forming apparatus according to Embodiment 1 of the invention shown in FIG. 1, a sheet feeding container TR1 containing recording sheets S as an example of a medium on which an image is recorded is housed in the lower portion and the top surface is provided with a sheet discharge unit TRh. An operation unit U1 is disposed in the upper portion of the printer U.

In FIG. 1, the printer U according to Embodiment 1 includes an image forming apparatus body U1 and an opening and shutting unit U2 which can open and shut about a rotation center U2*a* disposed at the right-lower end portion of the image forming apparatus body U1. The opening and shutting unit U2 can be switched between an opening position not shown where the inside of the image forming apparatus body U1 is opened to replace a process cartridge to be described later or to remove a jammed recording sheet S and a normal position, shown in FIG. 1, where the opening and shutting unit is held in a normal status where an image forming operation is carried out.

The printer U includes a control unit C making various controls of the printer U, an image processing unit GS of which the operation is controlled by the control unit C, an image writing device driving circuit DL, and a power supply device E. The power supply device E applies a voltage to charging rollers CRy to CRk as an example of a charging device to be described later, developing rollers G1*y* to G1*k* as an example of a developer holder, and transfer rollers T1*y* to T1*k* as an example of a transfer device.

The image processing unit GS converts print information input from an external image information transmitting device into image information for forming latent images corresponding to four color images of K (black), Y (yellow), M (magenta), and C (cyan) and outputs the image information to the image writing device driving circuit DL at a predetermined time. The image writing device driving circuit DL outputs driving signals to a latent image writing device ROS depending on the input image information of colors. The latent image writing device ROS outputs laser beams Ly, Lm, Lc, and Lk as an example of an image writing beam for writing color images depending on the driving signals.

In FIG. 1, visible image forming devices UY, UM, UC, and UK as an example of an image recording unit for forming toner images as examples of color visible images of Y, M, C, and K are disposed on the right side of the latent image writing device ROS.

Figure 2:
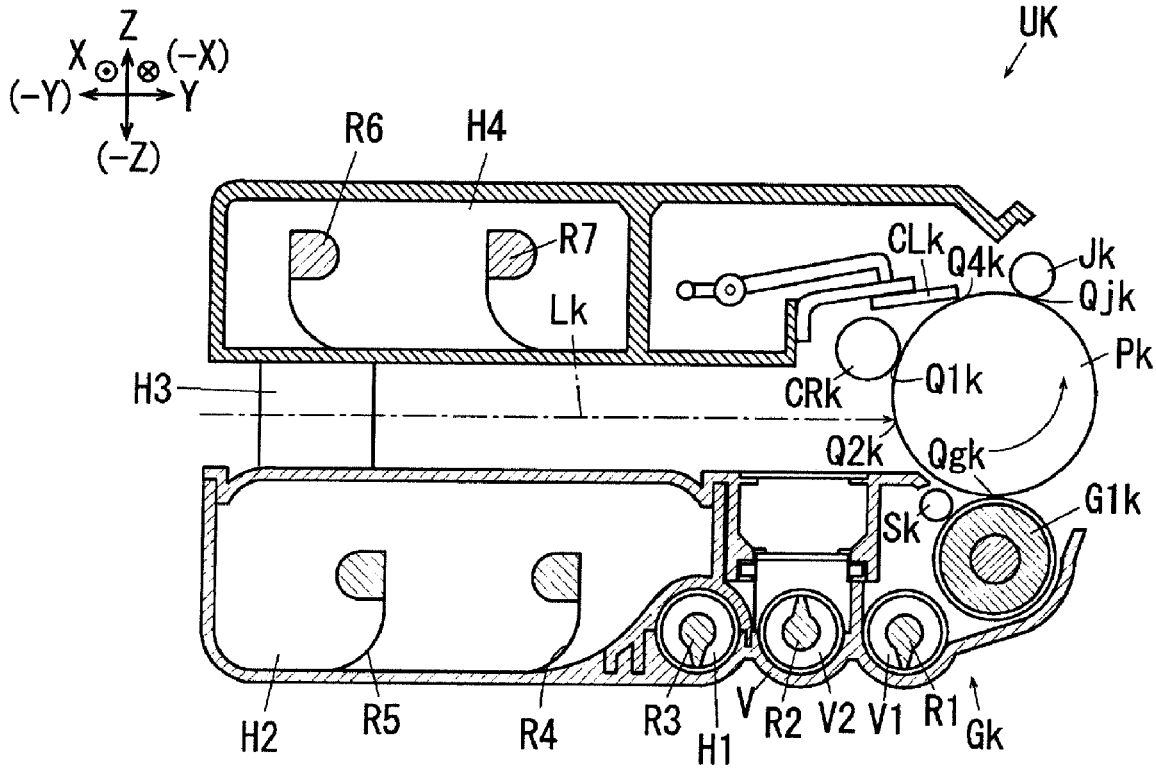
FIG. 2 is a diagram illustrating a visible image forming apparatus as an example of an attachable and detachable body according to Embodiment 1 of the invention.

FIG. 2 is a diagram illustrating a visible image forming device as an example of an attachable and detachable body according to Embodiment 1 of the invention.

In FIG. 2, the K (black) visible image forming device UK includes a photoconductor Pk as an example of a rotating image carrier. A charging roller CRk as an example of a charging device, a developing device Gk developing an electrostatic latent image on the surface of the photoconductor into a visible image, an electricity removing member Jk removing the electricity of the surface of the photoconductor Pk, and a photoconductor cleaner CLk as an example of an image carrier cleaner removing the developer remaining on the surface of the photoconductor Pk are disposed around the photoconductor Pk. The developing device Gk includes a developer container V containing the developer and a developing roller G1*k* as an example of a developer holder rotating to hold the developer contained in the developer container V. A layer thickness regulating member Sk opposed to the developing roller G1*k* to regulate the layer thickness of the developer on the surface of the developing roller G1*k* is disposed in the developer container V.

The developer container V includes agitation and transport chambers V1 and V2 in which the developer supplied to the developing roller G1*k* is agitated and transported. Circulation and transport members R1 and R2 circulating and transporting the developer are disposed in the agitation and transport chambers V1 and V2. A developer supply passage H1 for supplying the developer is connected to the left agitation and transport chamber V2 and a first developer supply chamber H2 containing the supply developer is connected to the developer supply passage H1. The first developer supply chamber H2 is connected to a second developer supply chamber H4 disposed above via a developer supply connecting passage H3. Supply developer transport members R3, R4, R5, R6, and R7 transporting the developer to the agitation and transport chambers V1 and V2 are respectively disposed in the developer supply passage H1, the first developer supply chamber H2, the developer supply connecting passage H3, and the second developer supply chamber H4. The members referenced by reference signs H1 to H4 and R3 to R7 constitute a developer supply container H1 to H4 and R3 to R7 of Embodiment 1.

The surface of the photoconductor Pk is uniformly charged in a charging area Q1*k* opposed to the charging roller CRk by the charging roller CRk and then a latent image is written thereto in a latent image forming area Q2*k* by a laser beam Lk.

The written electrostatic latent image is visualized in a visible image in a developing area Qgk opposed to the developing device Gk.

The black visible image forming device UK of Embodiment 1 is formed of an attachable and detachable body, that is, a process cartridge UK, to and from which the photoconductor Pk, the charging device CRk, the developing device Gk, the electricity removing member Jk, the photoconductor cleaner CLk, and the developer supply container H1 to H4 and R3 to R7 can be together attached and detached, and can be attached and detached to and from the image forming apparatus body U1 in the state where the opening and shutting unit U2 moves to the opening position.

Similarly to the black visible image forming device UK, the other color visible image forming devices UY, UM, and UC are respectively formed of attachable and detachable bodies, that is, process cartridges UY, UM, and UC, which can be attached and detached to and from the image forming apparatus body U1. In the printer U according to Embodiment 1, the process cartridges UY to UK are arranged in the vertical direction.

In FIG. 1, a belt module BM as an example of an displacement correcting device is disposed on the right side of the photoconductors Py to Pk. The belt module BM includes an endless medium conveying belt B as an example of an endless belt-shaped member opposed to the process cartridges UY to UK and an example of a medium conveying member. The medium conveying belt B is rotatably supported by a belt supporting roller Rd+Rj as an example of a belt-shaped member supporting member including a belt driving roller Rd as an example of a driving member and a driven roller Rj as an example of a rotation supporting member and an example of a driven member. The belt module BM includes transfer rollers T1*y*, T1*m*, T1*c*, and T1*k* as examples of transfer devices opposed to the photoconductors Py to Pk as an example of a counter member with the medium conveying belt B interposed therebetween. Here, the endless belt-shaped member is a member having an endless belt shape as described above and serves to hold and convey a medium on its surface or to hold and convey a visible image formed by a visible image forming device on its surface.

On the downstream side in the medium conveying direction of the medium conveying belt B, that is, on the upper side, an image concentration sensor SN1 as an example of an image concentration detecting member detecting a concentration-detecting image formed by image concentration adjusting means not shown in the control unit C, that is, a patch image, at a predetermined time is disposed. The image concentration adjusting means of the control unit C makes adjustment or correction of the image concentration, that is, a process control, by adjusting the voltages applied to the charging rollers CRy to CRk, the developing device Gy to Gk, and the transfer rollers T1*y* to T1*k* or adjusting the intensity of the latent image writing beams Ly to Lk on the basis of the image concentration detected by the image concentration sensor SN1.

A belt cleaner CLb as an example of a conveyer member cleaner is disposed on the downstream side of the image concentration sensor SN1 in the medium conveying direction of the medium conveying belt B.

The recording sheets S in the sheet feeding container TR1 disposed below the medium conveying belt B are taken out by a pickup roller Rp as an example of a medium taking-out member, are separated by a separation roller Rs as an example of a medium separating member sheet by sheet, and are conveyed to a recording medium conveying passage SH formed by a sheet guide SG as an example of a guide member.

The recording sheet S in the recording medium conveying passage SH is sent to a register roller Rr, which is an example of a feeding member, adjusting a feeding time to the medium conveying belt B. The register roller Rr feeds the recording sheet S to a recording medium sucking position Q6 which is an area opposed to the driven roller Rj at a predetermined time. The recording sheet S conveyed to the recording medium sucking position Q6 is electrostatically sucked to the medium conveying belt B. In the belt module BM of Embodiment 1, a guide member guiding the recording sheet S is omitted between the register roller Rr and the medium conveying belt B.

The recording sheet S sucked to the medium conveying belt B sequentially passes through the transfer areas Q3*y*, Q3*m*, Q3*c*, and Q3*k* contacting with the photoconductors Py to Pk.

A transfer voltage having the opposite polarity of the charging polarity of toner is applied to the transfer rollers T1*y* to T1*k* disposed on the rear side of the medium conveying belt B in the transfer areas Q3*y* to Q3*k* from the power supply circuit E controlled by the control unit C at a predetermined time.

In the case of multi-color images, toner images on the photoconductors Py to Pk are superposed and transferred to the recording sheet S on the medium conveying belt B by the transfer rollers T1*y* to T1*k*. In the case of a single color image, that is, a monochromatic image, only the K (black) toner image is formed on the photoconductor Pk and only the K (black) toner image is transferred to the recording sheet S by the transfer device T1*k*.

The photoconductors Py to Pk to which the toner images have been transferred are removed in electricity by the electricity removing members Jy to Jk in the electricity removing areas Qjy to Qjk, the toner remaining on the surfaces is recovered and cleaned by the photoconductor cleaners CLy to CLk in the cleaning areas Q4*y* to Q4*k*, and then the photoconductors are charged again by the charging rollers CRy to CRk.

The recording sheet S onto which the toner images are transferred is fixed in a fixing area Q5 formed by bringing a pressing roller Fp as an example of a pressurizing fixing member into pressed contact with a heating roller Fh as an example of a heating fixing member of the fixing device F. The recording sheet S to which the image is fixed is guided by a guide roller Rgk as an example of a discharge guide member and is discharged from a discharge roller Rh as an example of a medium discharge member to the medium discharge unit TRh.

The medium conveying belt B from which the recording sheet S is separated is cleaned by the belt cleaner CLb.

(Explanation of Belt Module Bm in Embodiment 1)

Figure 3:
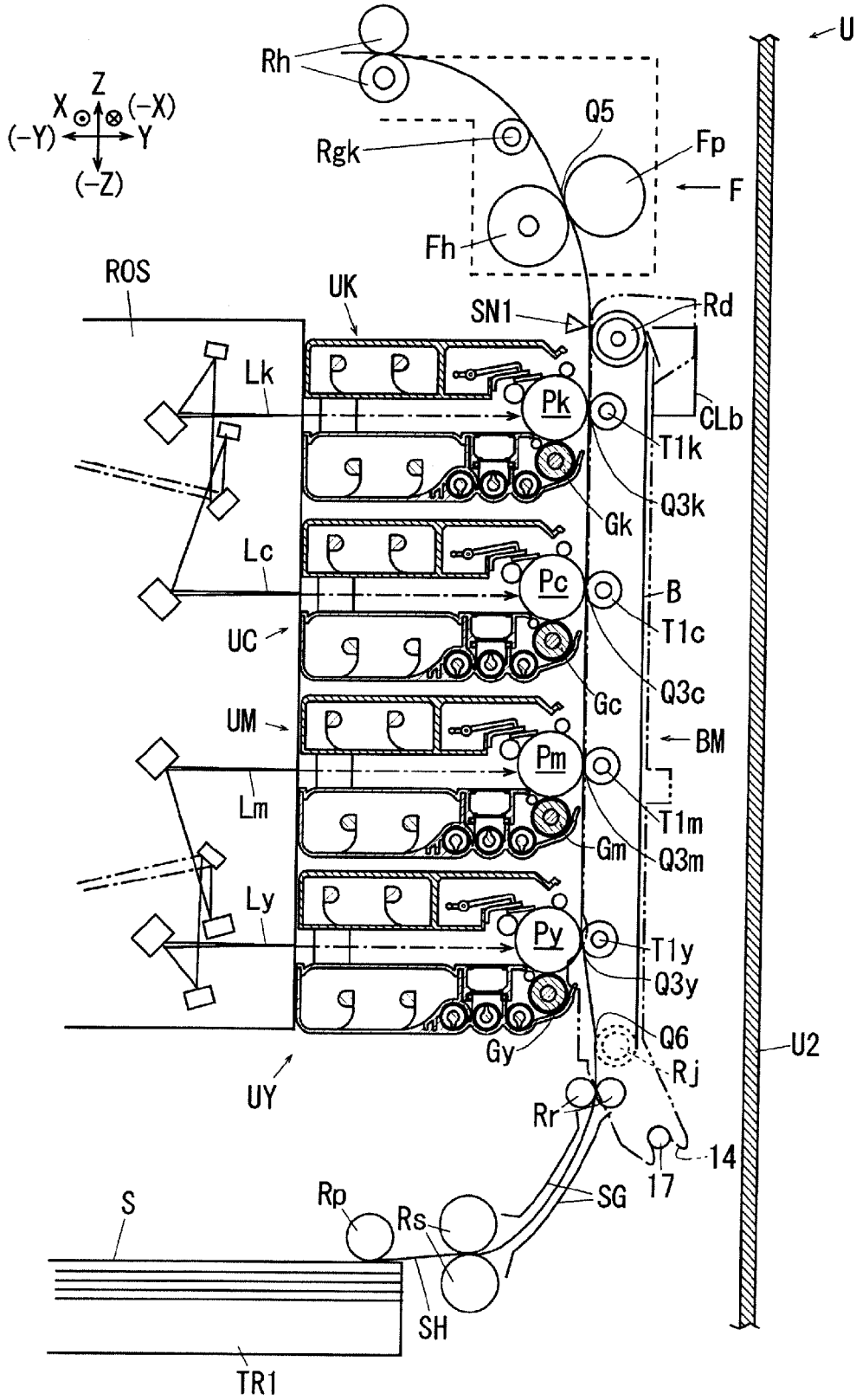
FIG. 3 is a partially enlarged view of the image forming apparatus according to Embodiment 1, where a belt module is held at a usage position.

FIG. 3 is a partially enlarged view of the image forming apparatus according to Embodiment 1, where the belt module is held at a usage position.

Figure 4:
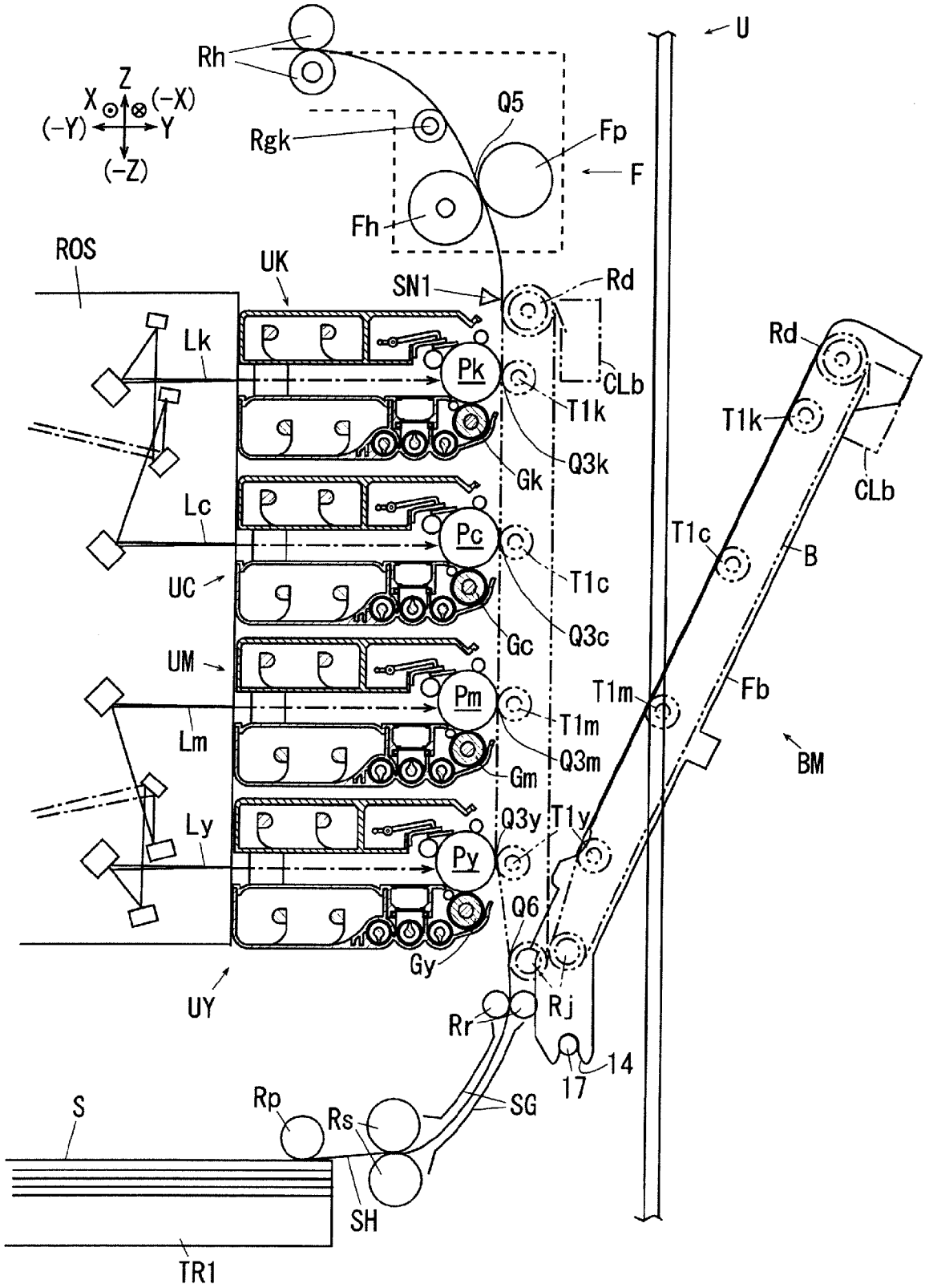
FIG. 4 is a partially enlarged view of the image forming apparatus according to Embodiment 1, where the belt module moves to a maintenance position.

FIG. 4 is a partially enlarged view of the image forming apparatus according to Embodiment 1, where the belt module moves to a maintenance position.

Figure 5:
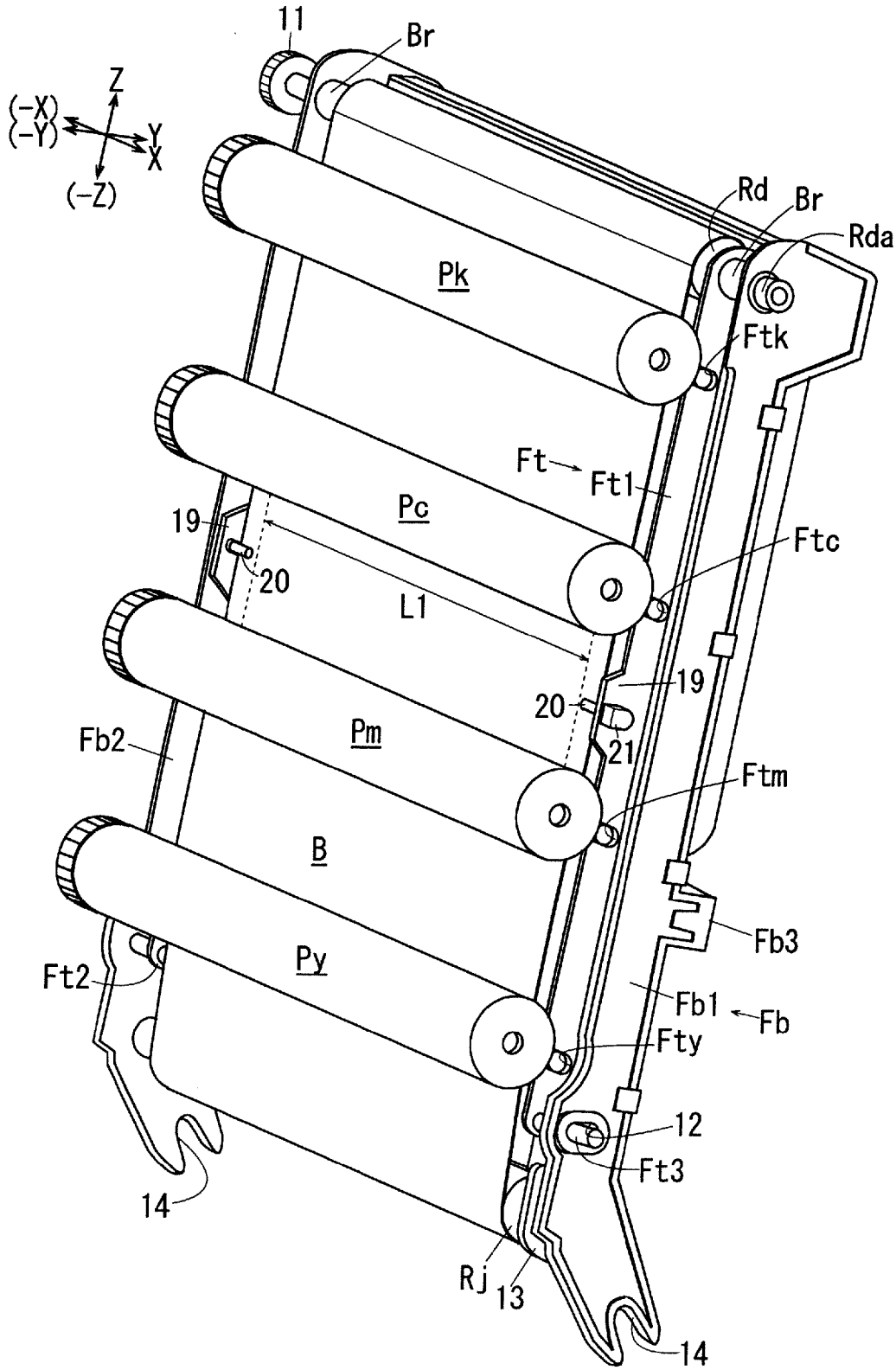
FIG. 5 is a perspective view of the belt module according to Embodiment 1, where a positional relation of an image carrier and a transfer roller of the belt module is shown.

FIG. 5 is a perspective view of the belt module according to Embodiment 1, where a positional relation of the image carrier and the transfer roller of the belt module is shown.

Figure 6A:
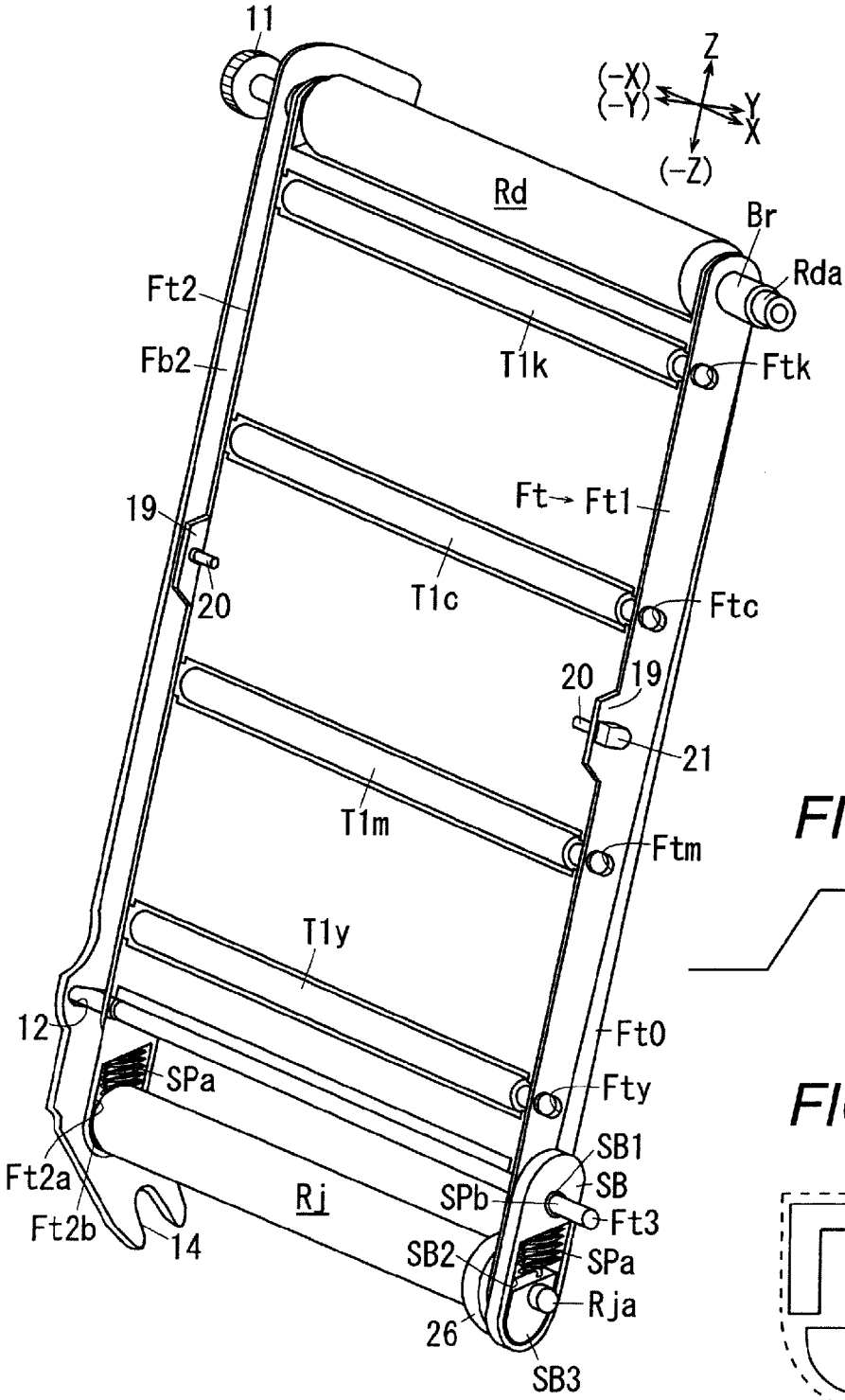
FIGS. 6A-6C are diagrams illustrating the belt module according to Embodiment 1, where
Figure 6B:
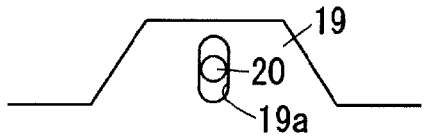
Figure 6C:
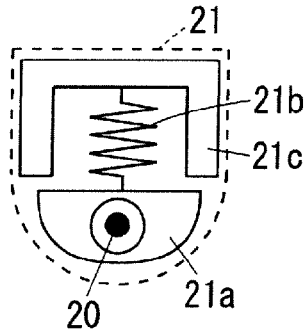

FIGS. 6A to 6C are diagrams illustrating the belt module according to Embodiment 1, where FIG. 6A is a perspective view of the belt module in a state where a front plate of a belt supporting frame and the medium conveying belt are detached from the belt module, FIG. 6B is a partially enlarged view of a longitudinal hole for adjusting the position of a pressing member, and FIG. 6C is a diagram illustrating a pin pressing mechanism.

Figure 7:
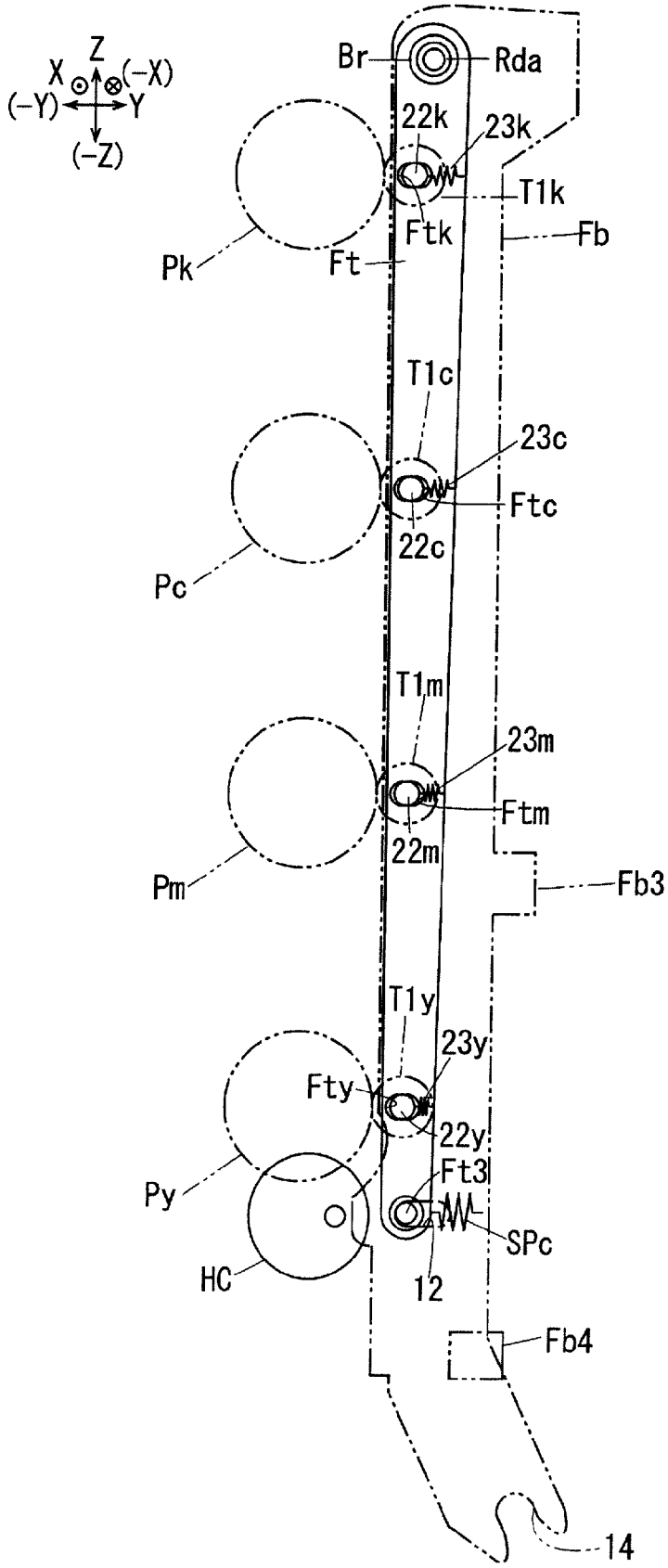
FIG. 7 is a side view of the belt module according to Embodiment 1, where a transfer frame is held at a pressed position.

FIG. 7 is a side view of the belt module according to Embodiment 1, where a transfer frame is held at a pressed position.

Figure 8:
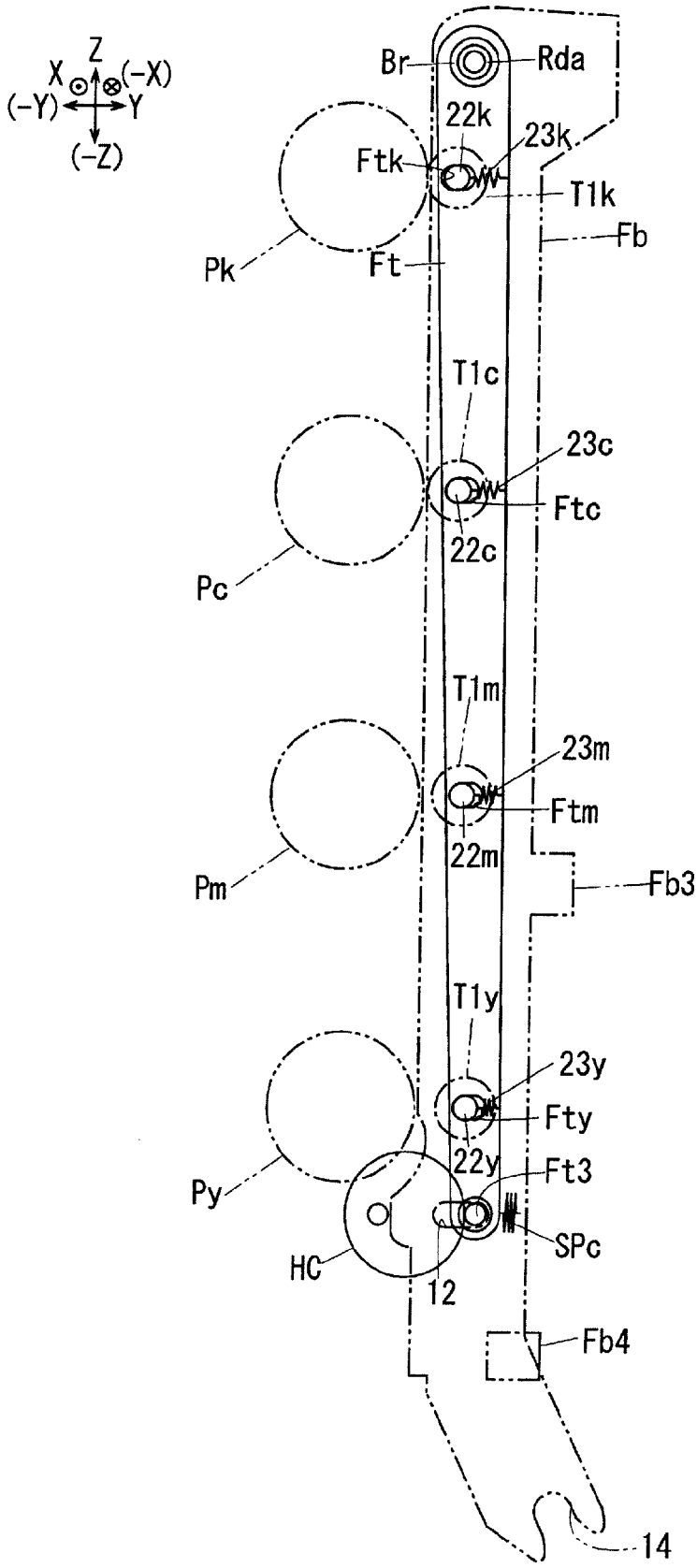
FIG. 8 is a side view of the belt module according to Embodiment 1, where the transfer frame moves to a separated position.

FIG. 8 is a side view of the belt module according to Embodiment 1, where the transfer frame moves to a separated position.

Figure 9:
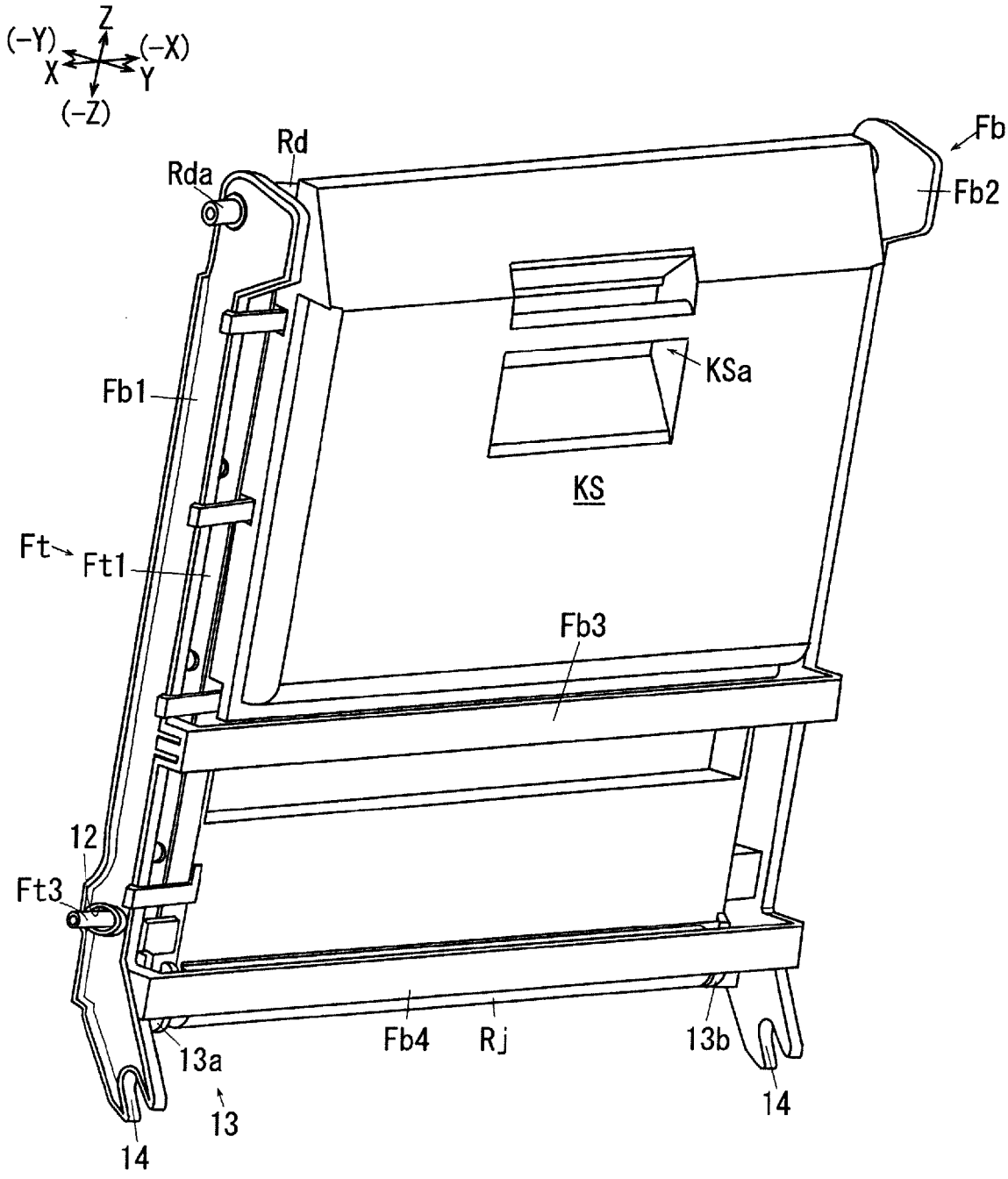
FIG. 9 is a perspective view of the belt module according to Embodiment 1, where the medium conveying belt is detached from the belt module.

FIG. 9 is a perspective view of the belt module according to Embodiment 1, where the medium conveying belt is detached from the belt module.

Figure 10A:
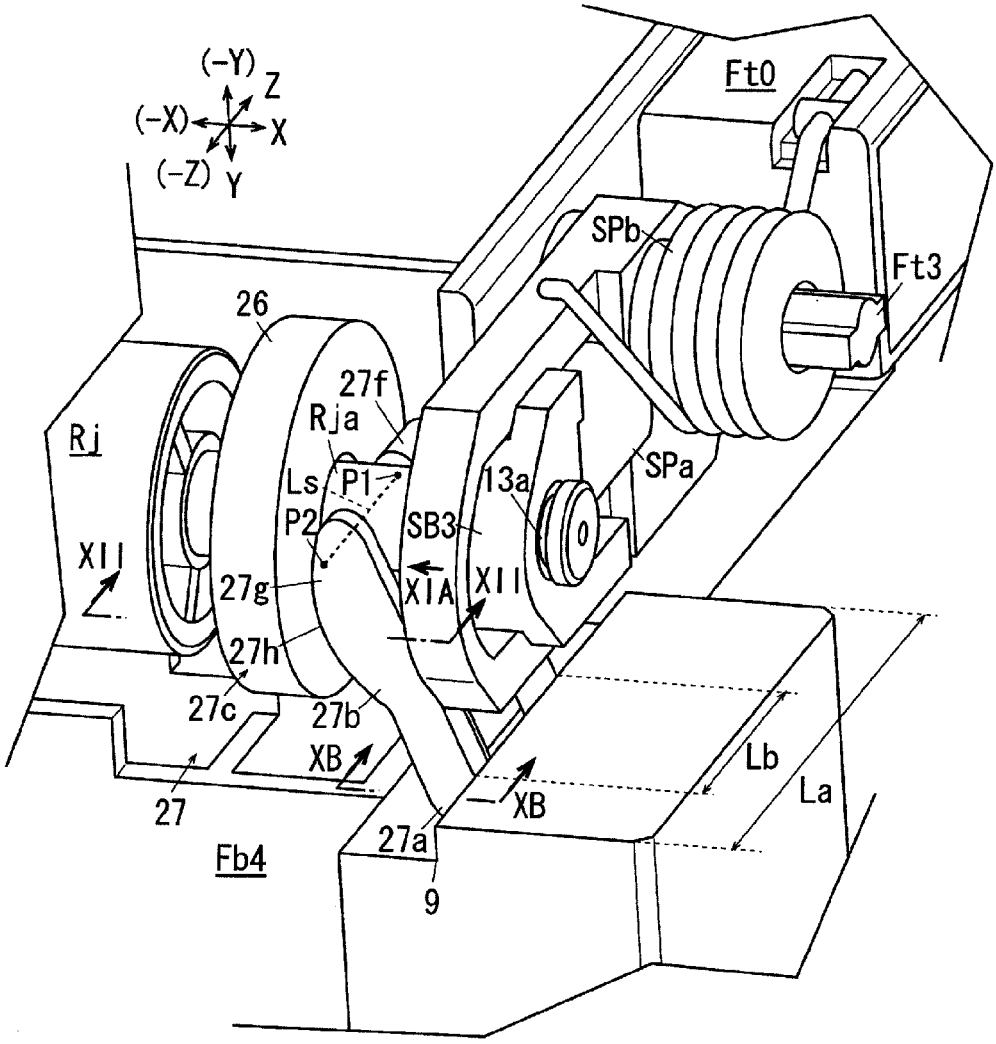
FIGS. 10A and 10B are enlarged perspective views of a belt displacement detecting member and a shaft displacing member in Embodiment 1, where
Figure 10B:
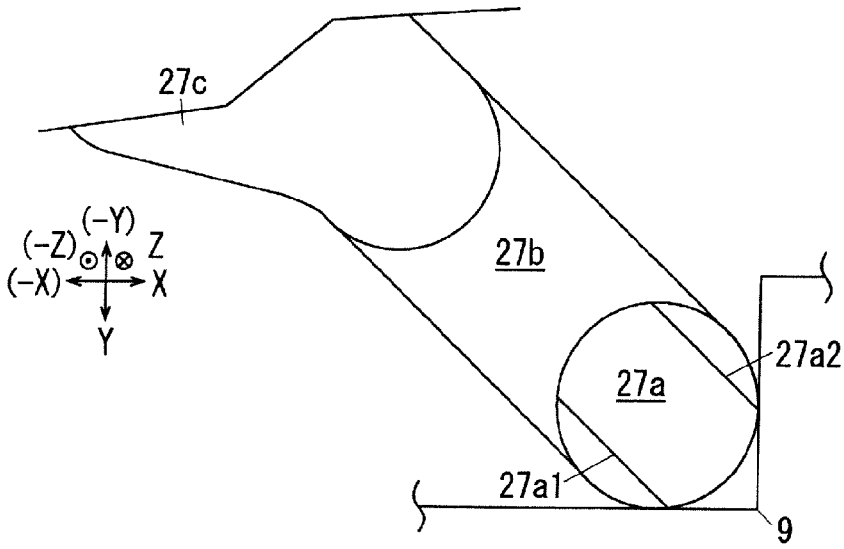

FIGS. 1A and 10B are perspective enlarged views of a belt displacement detecting member and a shaft displacing member in Embodiment 1, where FIG. 10A is an enlarged perspective view from the front end of the driven roller to the front bearing and FIG. 10B is a sectional view taken along line XB-XB of FIG. 10A.

In FIGS. 3 to 6 and FIG. 9, the belt module BM includes a pair of outer frames Fb as an example of the second frame and an example of a belt-shaped member supporting frame. The outer frames Fb include a front belt supporting plate Fb1 as an example of a front outer frame member and a rear belt supporting plate Fb2 as an example of a rear outer frame member. In FIGS. 5, 9, and 10, the front belt supporting plate Fb1 and the rear belt supporting plate Fb2 are connected to each other by an upper tie bar Fb3 as an example of an upper connection frame and a lower tie bar Fb4 as an example of a lower connection frame. In FIG. 10B, a corner portion 9 which has a step shape protruding to the left and which is an example of a center supporting portion extending in the vertical direction is formed at the front end portion of the lower tie bar Fb4 in Embodiment 1.

In FIGS. 5 and 6, a driving shaft Rda rotating integrally with the driving roller Rd is rotatably supported on the upper end portions of the front belt supporting plate Fb1 and the rear belt supporting plate Fb2 via bearings Br and Br. A rotary power transmission gear 11 is supported at the rear end portion of the driving shaft Rda and the rotary power is transmitted to the rear end portion of the driving shaft from a medium conveying member driving source not shown.

In FIGS. 5 and 6, longitudinal holes 12 and 12 as an example of a frame mounting portion extending in the lateral direction are formed in the lower portions of the front belt supporting plate Fb1 and the rear belt supporting plate Fb2.

In the front belt supporting plate Fb1 and the rear belt supporting plate Fb2, the driven roller Rj is rotatably supported on the lower sides of the longitudinal holes 12. In the driven roller Rj, a driven shaft Rja as an example of a rotation shaft of which the axial direction is parallel to the front and rear directions which is the width direction of the medium conveying belt B is supported by a driven shaft supporting member 13 as an example of the rotation shaft supporting body shown in FIG. 10. The driven shaft supporting member 13 of Embodiment 1 includes a front bearing 13*a* as an example of a one-end supporting portion rotatably supporting the front end portion as an example of one end portion of the driven shaft Rja and a rear bearing 13*b* as an example of an opposite-end supporting portion rotatably supporting the rear end portion as an example of the opposite end portion of the driven shaft Rja.

In FIGS. 3 to 5 and FIG. 9, grooves 14 and 14 are formed at the lower end portions of the front belt supporting plate Fb1 and the rear belt supporting plate Fb2. In FIGS. 3 and 4, the grooves 14 and 14 are rotatably supported by a frame supporting shaft 17 supported by the image forming apparatus body U1. The belt module BM can rotate between a normal usage position shown in FIG. 3 and a maintenance position shown in FIG. 4 around the frame supporting shaft 17.

In FIG. 3, in the state where the belt module BM moves to the normal usage position, the bearings Br and Br supporting both ends of the driving shaft Rda come in contact with a positioning portion not shown but disposed in the image forming apparatus body U1 and thus the belt module BM is positioned.

In FIG. 4, when maintenance works such as solving the paper jam or replacing the visible image forming devices UY to UK are carried out, the inside is open and thus the maintenance works are possible, by opening the opening and shutting unit U2 to move the belt module BM to the maintenance position.

In FIGS. 5 and 6, the transfer frame Ft as an example of a first frame and an example of a transfer member supporting frame is disposed inside the outer frame Fb. The transfer frame Ft includes a front transfer roller supporting plate Ft1 and a rear transfer roller supporting plate Ft2 as an example of a pair of front and rear transfer member supporting bodies. Both end portions of the driving shaft Rda rotatably penetrate the upper end portions of the front transfer roller supporting plate Ft1 and the rear transfer roller supporting plate Ft2. That is, the upper end portion of the transfer frame Ft is rotatably supported by the driving shaft Rda of the driving roller Rd.

The lower portions of the front transfer roller supporting plate Ft1 and the rear transfer roller supporting plate Ft2 are connected to each other by a plate connecting member Ft3 as an example of a transfer member supporting body connecting member. Both end portions of the plate connecting member Ft3 pass through the longitudinal holes 12 and 12 of the front belt supporting plate Fb1 and the rear belt supporting plate Fb2 and protrude outward from the outer frame Fb. Therefore, the plate connecting member Ft3 is supported to freely move along the longitudinal holes 12 and 12.

A swing bracket SB as an example of a movable frame is supported by the front end portion of the plate connecting member Ft3 so as to be rotatable about the plate connecting member Ft3.

A through hole SB1 transmitting and supporting the plate connecting member Ft3 is formed in the upper end portion of the swing bracket SB of Embodiment 1. A spring supporting groove SB2 having a groove shape extending in the vertical direction is formed as an example of an elastic member supporting portion below the through hole SB1. A slider SB3 as an example of a suspended movable body movable along the spring supporting groove SB2 is supported in the swing bracket SB and the front bearing 13*a* is supported in the slider SB3. A suspending spring SPa as an example of an elastic member and an example of a tension applying member is disposed between the slider SB3 and the upper end portion of the spring supporting groove SB2.

Therefore, the front bearing 13*a* is connected to the plate connecting member Ft3 with the swing bracket SB interposed therebetween and is supported to be rotatable about the plate connecting member Ft3 by interlocking with the swing bracket SB.

The rear transfer roller supporting plate Ft2 extends longer downward than the front transfer roller supporting plate Ft1. The lower portion of the rear transfer roller supporting plate Ft2 of Embodiment 1 includes a spring supporting groove Ft2*a* similar to the spring supporting groove SB2 and a slider Ft2*b* supporting the rear bearing 13*b* to correspond to the slider SB3. Similarly to the swing bracket SB, a suspending spring SPa is disposed between the slider Ft2*b* and the upper end portion of the spring supporting groove Ft2*a*.

Therefore, the rear bearing 13*b* is supported by the rear transfer roller supporting plate Ft2 with the slider Ft2*b* interposed therebetween so as to be movable in the vertical direction.

The bearings 13*a* and 13*b* are urged downward by the suspending springs SPa and SPa. That is, the driven roller Rj is supported in the state where it is pressed to the down side as an example of the downstream side in the suspending direction so as to suspend the medium conveying belt B and has a function of the suspending member suspending the medium conveying belt B.

A bracket pressing spring SPb as an example of a tilt urging member of which one end is supported by the front transfer roller supporting plate Ft1 and the other end is supported by the swing bracket SB is supported by the plate connecting member Ft3. That is, the swing bracket SB of Embodiment 1 is urged to the corner portion 9 of the lower tie bar Fb4 disposed on the right side by the bracket pressing spring SPb. As a result, in Embodiment 1, the front end portion of the driven shaft Rja of the driven roller Rj is set in advance to be displaced to the right about the rear end portion thereof.

The driving shaft Rda of the driving roller Rd of Embodiment 1 is disposed parallel to the front and rear directions. Therefore, in Embodiment 1, the medium transfer belt B is set in advance to be displaced to the front direction.

In the front transfer roller supporting plate Ft1 and the rear transfer roller supporting plate Ft2, shaft position adjusting longitudinal holes Fty, Ftm, Ftc, and Ftk extending in the left and right directions are formed to correspond to the positions of the transfer rollers T1*y* to T1*k*. In FIG. 6, in the front transfer roller supporting plate Ft1 and the rear transfer roller supporting plate Ft2, a fixing member supporting portion 19 protruding toward the image carriers Py to Pk, that is, from the inside to the outside of the medium conveying belt B is formed between the shaft position adjusting longitudinal hole Ftm for magenta and the shaft position adjusting longitudinal hole Ftc for cyan. In FIG. 6B, a fixing member positioning longitudinal hole 19*a* extending in the left and right directions is formed in the fixing member supporting portion 19. The fixing member positioning longitudinal hole 19*a* transmits and supports a belt pressing pin 20 as an example of a fixing member so as to be movable along the fixing member positioning longitudinal hole 19*a*.

In FIG. 6A, a pin pressing mechanism 21 as an example of a fixing member urging mechanism supported by the front transfer roller supporting plate Ft1 and the rear transfer roller supporting plate Ft2 supports the outer end portion of the belt pressing pin 20. In FIG. 6C, the pin pressing mechanism 21 includes a bearing member 21*a* rotatably supporting the outer end portion of the belt pressing pin 20. The bearing member 21*a* is always pressed to the medium conveying belt B by an end of an elastic spring 21*b* as an example of a pressing force generating member. The other end of the elastic spring 21*b* is supported by a spring supporting container 21*c*.

As shown in FIG. 5, the pair of front and rear belt fixing pins 20 of Embodiment 1 is disposed outside a cleaning area L1 in which the surface of the medium conveying belt B is cleaned by the belt cleaner CLb. In Embodiment 1, the cleaning area L1 is set to be broader than the maximum width of the usable recording sheet S, and the maximum width of an image forming area which is the area of the images formed on the photoconductor Py to Pk is set to be smaller than the maximum width of the recording sheet S.

In FIGS. 5, 6A, and 7, the shafts 22*y*, 22*m*, 22*c*, and 22*k* of the transfer rollers T1*y*, T1*m*, T1*c*, and T1*k* are supported to be laterally movable by a predetermined distance along the shaft positioning longitudinal holes Fty, Ftm, Ftc, and Ftk. The shafts 22*y* to 22*k* of the transfer rollers T1*y* to T1*k* are supported by a shaft urging mechanism not shown but configured similarly to the pin pressing mechanism 21. That is, in FIGS. 7 and 8, the transfer rollers T1*y* to T1*k* are urged to press on the medium conveying belt B to the outer surface, that is, to the photoconductors Py to Pk by transfer shaft urging springs 23*y*, 23*m*, 23*c*, and 23*k* corresponding to the elastic spring 21*b*, as schematically shown.

In Embodiment 1, the pressing force of the transfer shaft urging springs 23*y* to 23*k* is set to be greater than the pressing force of the elastic spring 21*b*. The force with which the elastic spring 21*b* presses the medium conveying belt B is set to be slightly greater than the tension of the medium conveying belt B and to bring the belt pressing pin 20 into contact with the medium conveying belt B but to hardly deform the shape of the medium conveying belt B.

In FIGS. 7 and 8, a transfer frame pressing spring SPc as an example of a support member urging member applying the force for always pressing the plate connecting member Ft3 to the photoconductors Py to Pk is disposed between the plate connecting member Ft3 and the lower end portion of the outer frame Fb. An eccentric cam HC as an example of a belt-shaped member contacting and separating member supported by the image forming apparatus body U1 is disposed in the plate connecting member Ft3 to be opposed to the transfer frame pressing spring SPc.

Therefore, when the eccentric cam HC moves to a belt-shaped member contact position shown in FIG. 7, the transfer frame Ft is pressed to the photoconductors Py to Pk by the transfer frame pressing spring SPc and thus the medium conveying belt B comes in contact with all the photoconductors Py to Pk. In this state, multi-color images are formed and transferred. When the eccentric cam HC moves to a belt-shaped member separating position shown in FIG. 8, the transfer frame Ft rotationally moves against the elastic force of the transfer frame pressing spring SPc and the medium conveying belt B is thus separated from the photoconductors Py, Pm, and Pc other than black. In this state, a monochromatic image is formed and transferred. That is, in Embodiment 1, the black photoconductor Pk always contacts with the medium conveying belt B and the other color photoconductors Py, Pm, and Pc come in contact with and are separated from the medium conveying belt B.

In FIG. 9, a recovering device KS having built therein the belt cleaner CLb for cleaning paper dust or developer attached to the medium conveying belt B at the time of conveying the recording sheet S is supported on the right side of the outer frame Fb. A grasp portion KSa which is grasped by a user at the time of rotating the belt module BM from the normal usage position shown in FIG. 3 to the maintenance position shown in FIG. 4 is formed in the recovering device KS.

(Explanation of Belt Displacement Detecting Member 26 and Shaft Displacing Member 27 in Embodiment 1)

In FIGS. 10A and 10B, a disc-like belt displacement detecting member 26 as an example of an interlocking body contacting with a front edge as an example of the widthwise edge of the medium conveying belt B and an example of a movement detecting member is supported at the front end portion of the driven shaft Rja so as to be movable in the front and rear directions which are the axial direction. A shaft displacing member 27 tilting the rotation shaft to the left side as an example of the tilt direction is disposed between the belt displacement detecting member 26 and the front bearing 13*a*. The interlocking body comes in contact with a part of the end surface of the endless belt-shaped member to move and detects the position in the width direction of the endless belt-shaped member.

Figure 11A:
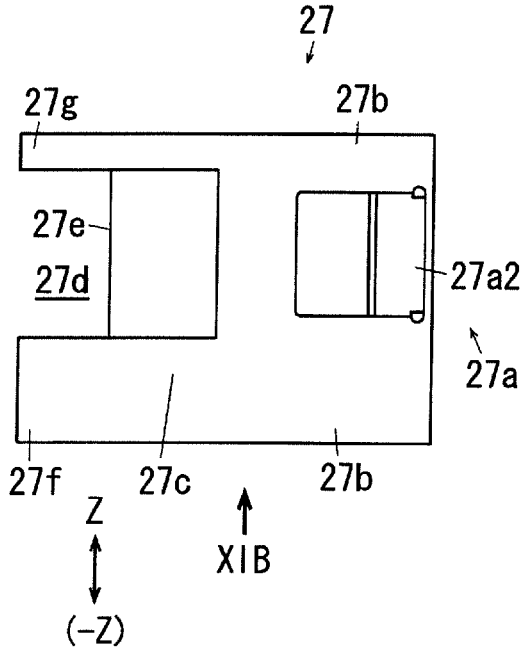
FIGS. 11A to 11D are enlarged views of the shaft displacing member according to Embodiment 1, where
Figure 11B:
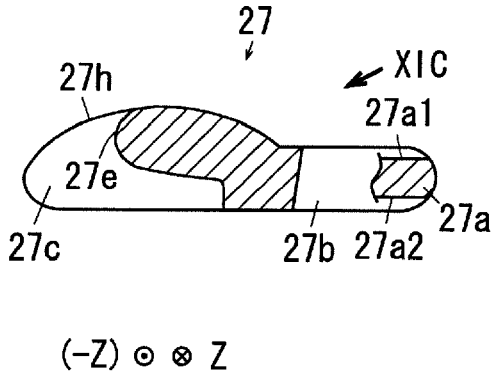
Figure 11C:
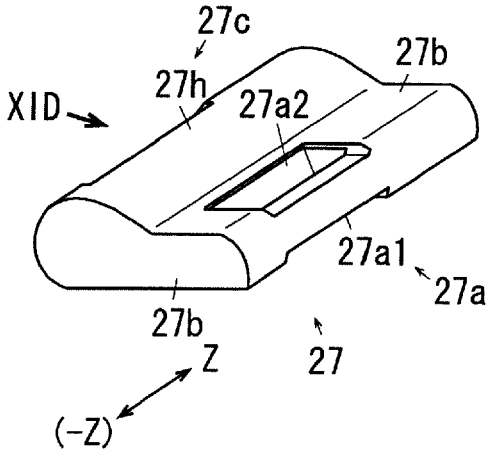
Figure 11D:
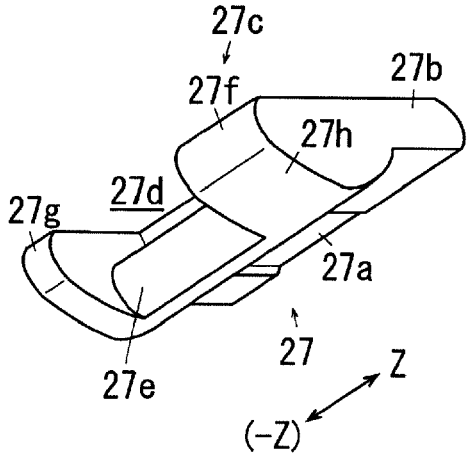

FIGS. 11A to 11D are enlarged views of the shaft displacing member according to Embodiment 1, where FIG. 11A is an enlarged view as viewed in the direction of arrow XIA in FIG. 10, FIG. 11B is an enlarged view as viewed in the direction of arrow XIB in FIG. 11A, FIG. 11C is an enlarged view as viewed in the direction of arrow XIC in FIG. 11B, and FIG. 11D is an enlarged view as viewed in the direction of arrow XID in FIG. 11C.

In FIGS. 10 and 11A to 11D, the shaft displacing member 27 of Embodiment 1 includes a rotation center 27*a* being disposed on the right side of the driven shaft Rja and extending in the vertical direction as an example of an intersecting direction intersecting the driven shaft Rja.

In FIGS. 10B and 11A to 11D, the rotation center 27*a* of Embodiment 1 is formed in a shape obtained by cutting out a part of both ends in the front and rear directions of the outer surface of a cylinder and has cut surfaces 27*a*1 and 27*a*2. That is, as shown in FIG. 10B, the rotation center 27*a* is formed in a shape obtained by cutting the left and right end portions of a circle in which the outer surface of a cylinder is partially cut, that is, in a sectional shape like a double D shape. The rotation center 27*a* is rotatably supported by the corner portion 9 of the lower tie bar Fb4.

In Embodiment 1, the vertical length La of the corner portion 9 is set in advance to be greater than the vertical length Lb of the rotation center 27*a*. That is, the vertical width of the corner portion 9 is greater than the vertical width of the shaft displacing member 27. As a result, the rotation center 27*a* contacted and supported by the corner portion 9 of Embodiment 1 is movable in the vertical direction in which the corner portion 9 extends.

A columnar extending portion 27*b* extending in parallel to the cut surfaces 27*a*1 and 27*a*2 is formed in both end portions in the vertical direction which is the axial direction of the rotation center 27*a*. A semi-circular column contact portion 27*c* having a D-shaped section extending in the vertical direction is formed in the end portion of the extending portion 27*b* which is the opposite portion of the rotation center 27*a*. A concave portion 27*d* formed of an opening cut in a concave shape at the center in the vertical direction of the opposite outer end portion of the extending portion 27*b* is formed in the contact portion 27*c* of Embodiment 1. A shaft contact surface 27*e* which is formed of a convex curved body extending in the vertical direction and is an example of a rotation shaft contact portion contacting with the driven shaft Rja is formed in the concave portion 27*d* of Embodiment 1.

An upper contact portion 27*f* as an example of an upstream contact portion of a two-forked shape with the concave portion 27*d* interposed therebetween and a lower contact portion 27*g* as an example of a downstream contact portion are formed in both end portions in the vertical direction of the concave portion 27*d*. The left end surface 27*h* which is the contact surface of the contact portions 27*f* and 27*g* contacts with the belt displacement detecting member 26 on both sides in the vertical direction with the driven shaft Rja interposed therebetween.

The interlocking body contact portion (27*f*+27*g*) of Embodiment 1 is constructed by the upper contact portion 27*f* and the lower contact portion 27*g*.

Figure 12:
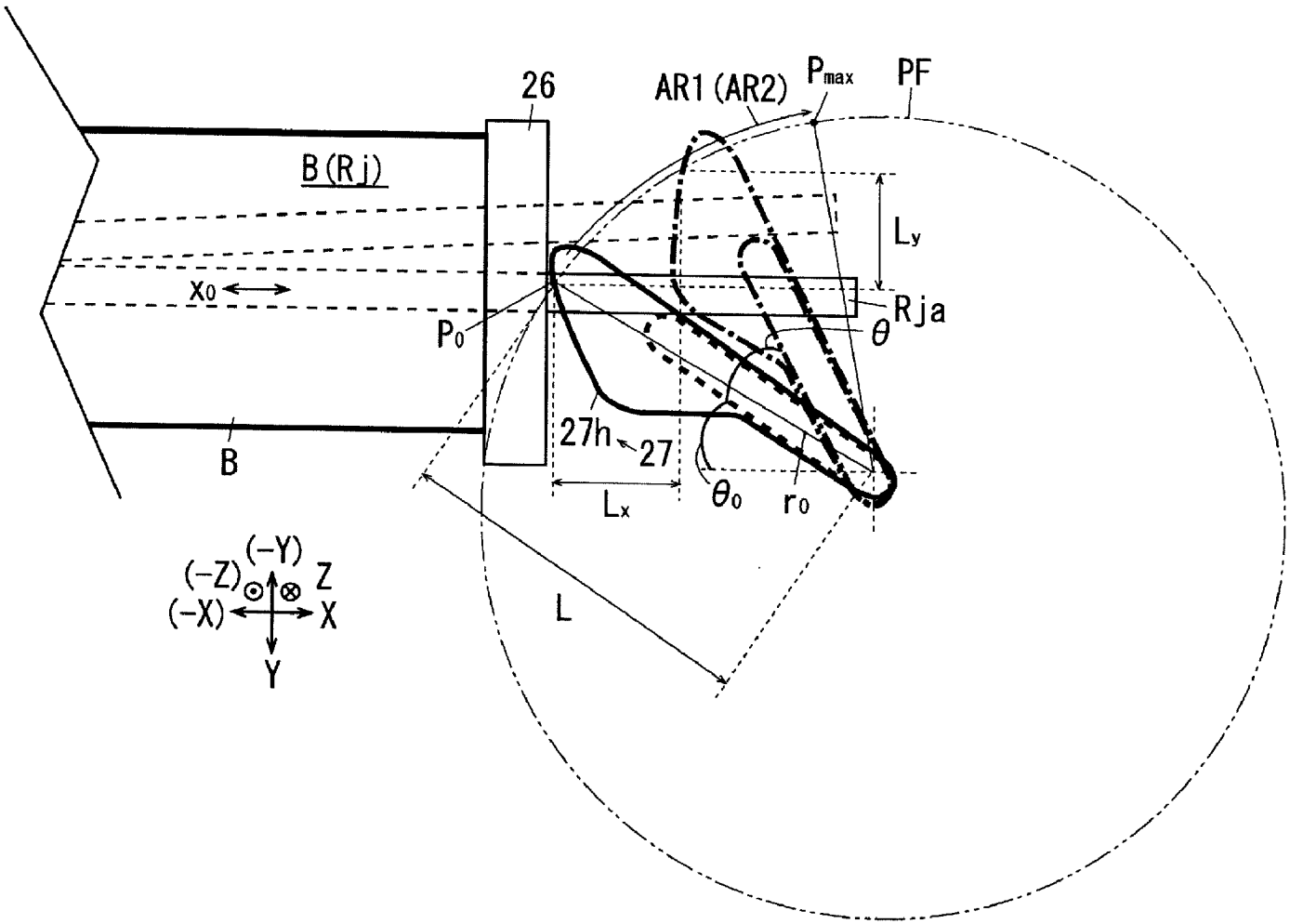
FIG. 12 is a sectional view taken along line XII-XII of FIG. 10A, where the relation of the movement of the medium conveying belt to the front side and the movement of the driven shaft to the left side by the shaft displacing member is shown.

FIG. 12 is a sectional view taken along line XII-XII of FIG. 10A, where the relation of the movement of the medium conveying belt to the front side and the movement of the driven shaft to the left side by the shaft displacing member is shown.

In FIG. 12, the left end surface 27*h* of the interlocking body contact portion (27*f*+27*g*) of Embodiment 1 increases in curvature as it goes from the outer end portion of the concave portion 27*d* to the extending portion 27*b*. Specifically, when the members B and 26 move in the front direction which is the width direction of the medium conveying belt B, the locus of the contact point between the belt displacement detecting member 26 and the left end surface 27*h*, that is, a contact profile PF, is set in advance to form a circular arc. A belt moving mechanism Fb+Ft+SPc+HC as an example of a belt-shaped member moving mechanism of Embodiment 1 is constructed by the outer frame Fb, the transfer frame Ft, the transfer frame pressing spring SPc, and the eccentric cam HC. The belt module BM of Embodiment 1 is constructed by the outer frame Fb, the belt supporting rollers Rd+Rj, the medium conveying belt B, the transfer frame Ft, the transfer rollers T1*y* to T1*k*, the recovering device KS, the belt displacement detecting member 26, and the shaft displacing member 27.

(Operation of Embodiment 1)

In the printer U as an example of the image forming apparatus according to Embodiment 1 having the above-mentioned configuration, when an image forming operation, that is, a job, is started, a recording sheet S is held on the surface of the medium conveying belt B, an image is transferred to the recording sheet S at the time of passing the transfer areas Q3*y* to Q3*k*, and the image is fixed in the fixing area Q5 of the fixing device F.

Here, when the medium conveying belt B meanders, a problem is caused in the conveyance of the recording sheet S. In Embodiment 1, as shown in FIG. 10, the front end portion of the driven shaft Rja of the driven roller Rj is urged to the lower tie bar Fb4 on the right side with the members SPb, SB, and 13*a* therebetween. That is, the front end portion of the driven shaft Rja is leaned to the right relative to the rear end portion and is leaned relative to the driving shaft Rda of the driving roller Rd extending in the front and rear directions. Accordingly, as shown in FIG. 12, when the medium conveying belt B is displaced, it is set to be displaced to the front side. When the medium conveying belt B is displaced to the front side, the front edge of the medium conveying belt B comes in contact with the belt displacement detecting member 26 and the medium conveying belt B and the belt displacement detecting member 26 move to the front side together.

Therefore, the belt displacement detecting member 26 presses the interlocking body contact portion (27*f*+27*g*) in contact to the front side and thus the interlocking body contact portion (27*f*+27*g*) of the pressed shaft displacing member 27 rotates about the rotation center 27*a*. In this case, the shaft contact surface 27*e* of the shaft displacing member 27 rotates together with the interlocking body contact portion (27*f*+27*g*) and presses the driven shaft Rja to the left side.

Therefore, the medium conveying belt B moves to the rear side and the front end of the driven shaft Rja comes close to the rear end in parallel or is tilted to the rear side, whereby the front end is maintained at an equilibrium position at which the displacement of the medium conveying belt B is stopped. Therefore, the displacement of the medium conveying belt B is regulated and the displacement of the medium conveying belt B is resolved. That is, in the printer U according to Embodiment 1, as the members B and 26 move to the front side, the shaft displacing member 27 rotates in the XY plane including the X direction as the front and rear directions and the Y direction as the left and right directions to move the driven shaft Rja in the left direction.

Therefore, in the printer U according to Embodiment 1, with the displacement of the members B and 26, the shaft displacing member 27 rotates about the rotation center 27*a* to tilt the driven shaft Rja. Accordingly, the structure for correcting the meandering of the medium conveying belt B is much simpler than the technique described in JP-A-2001-80782 in which the pressing force of the belt displacement detecting member is measured to tilt the driven shaft or the technique described in JP-B-6-99055 in which the driven shaft is tilted by applying a torque of the medium conveying belt B to the belt displacement detecting member to wind the string member.

In the printer U according to Embodiment 1, since the rotation locus of the shaft displacing member 27 forms a two-dimensional circular shape, the structure for correcting the meandering of the medium conveying belt B is much simpler than the technique described in JP-A-2006-162659 in which the rotation locus of the shaft displacing member forms a three-dimensional bevel shape.

In the printer U according to Embodiment 1, the curvature of the left end surface 27*h* is set so that the contact profile PF shown in FIG. 12 forms a circular arc. That is, in Embodiment 1, as shown in FIG. 12, when the line segment of the shaft displacing member 27 connecting the rotation center 27*a* to the interlocking body contact position at which the interlocking body contact portion (27*f*+27*g*) and the belt displacement detecting member 26 come in contact with each other is a shaft displacing line segment $r_0$, the straight line in the width direction of the medium conveying belt B before the movement of the medium conveying belt B, that is, the straight line corresponding to the driven shaft Rja tilted about the driving shaft Rda, is a widthwise straight line $x_0$, the length of the shaft displacing line segment $r_0$ is L [mm], the angle formed by the shaft displacement segment $r_o$ and the widthwise straight line $x_0$ is $\theta_0$ [rad], the displacement amount of the members B and 26 to the front side is Lx [mm], the increasing angle of the angle $\theta_0$ after the movement of the members B and 26 is θ [rad], and the moving amount of the front end portion of the driven shaft Rja to the left side by the shaft displacing member 27 is Ly[mm], the relation of the rotating angles $\theta_0$ and θ of the shaft displacing member 27 and the moving amounts Lx and Ly is set in advance to satisfy Expressions (1-1) and (1-2).

$$Lx=L(\cos(\theta_0)-\cos(\theta_0+\theta)) \quad (1\text{-}1)$$

$$Ly=L(\sin(\theta_0+\theta)-\sin(\theta_0)) \quad (1\text{-}2)$$

Therefore, in the printer U according to Embodiment 1, as expressed in Expressions (1-1) and (1-2), the relation between the moving amounts Lx and Ly can be adjusted on the basis of the trigonometric function of the angles $\theta_0$ and θ of the shaft displacing member 27.

Therefore, in the printer U according to Embodiment 1, it is possible efficiently to adjust the moving amount Lx [mm] of the members B and 26 into the moving amount Ly [mm] of the driven shaft Rja by the use of the rotation of the shaft displacing member 27, compared with the case where the moving amounts Lx and Ly cannot be adjusted on the basis of Expressions (1-1) and (1-2).

In the printer U according to Embodiment 1, it is possible to adjust the relation of the moving amount Lx [mm] of the members B and 26 and the moving amount Ly [mm] of the driven shaft Rja on the basis of the curvature of the left end surface 27*h* which is the contact surface with the belt displacement detecting member 26.

In the printer U according to Embodiment 1, it is possible to allow the movement of the members B and 26 to smoothly interlock with the rotation of the shaft displacing member 27, compared with the case where the moving amounts Lx and Ly cannot be adjusted on the basis of Expressions (1-1) and (1-2). Accordingly, in the printer U according to Embodiment 1, for example, even when the equilibrium position is changed in the multi-color image forming operation shown in FIG. 7, that is, a full color mode, and in the monochromatic image forming operation shown in FIG. 8, that is, a monochromatic mode, it is possible rapidly to converge the movement of the driven shaft Rja by the shaft displacing member 27, thereby rapidly correcting the meandering of the medium conveying belt B. For example, even when the equilibrium position is changed depending on the kind of medium at the time of conveying regular paper or thick paper, it is possible to rapidly converge the movement of the driven shaft Rja by the shaft displacing member 27, thereby rapidly correcting the meandering of the medium conveying belt B.

In the printer U according to Embodiment 1, the noise at the time of correcting the meandering of the medium conveying belt B is reduced, compared with the configuration in which the left end surface 27*h* does not smoothly and continuously vary in curvature.

In the printer U according to Embodiment 1, the driven shaft Rja formed in a cylindrical shape extending in the front and rear directions comes in point contact with the shaft contact surface 27*e* formed of the convex curved body extending in the vertical direction. Accordingly, in the printer U according to Embodiment 1, compared with the configuration in which the driven shaft Rja does not come in point contact with the shaft contact surface 27*e*, it is possible to reduce the noise at the time of correcting the meandering of the medium conveying belt B and to reduce the abrasion of the driven shaft Rja and the shaft contact surface 27*e*, thereby reducing the maintenance cost of the shaft displacing member 27.

In the printer U according to Embodiment 1 having the above-mentioned configuration, as shown in FIG. 6, the bearings 13*a* and 13*b* of the driven shaft Rja are supported by the slider SB3 of the swing bracket SB and the slider Ft2*b* in the lower end portion of the rear transfer roller supporting plate Ft2. As shown in FIG. 10, the rotation center 27*a* of the shaft displacing member 27 is rotatably supported by the inner peripheral surface 9*a* of the corner portion 9 of the lower tie bar Fb4. That is, in the printer U according to Embodiment 1, the driven shaft Rja is supported by the transfer frame Ft as an example of the first frame and the shaft displacing member 27 is supported by the outer frame Fb as an example of the second frame.

As a result, in the printer U according to Embodiment 1, compared with the configuration in which the driven shaft Rja and the shaft displacing member 27 are supported by the same frame, it is possible to easily mount the shaft displacing member 27 on the belt module BM. In addition, in the printer U according to Embodiment 1, compared with the configuration in which the driven shaft Rja and the shaft displacing member 27 are supported by the same frame, it is possible to secure a wide space for disposing the portions 27*a* to 27*e* of the shaft displacing member 27 and particularly to enhance the degree of freedom in the arrangement of the rotation center 27*a*.

In the printer U according to Embodiment 1 having the above-mentioned configuration, as shown in FIG. 10A, the corner portion 9 supporting the rotation center 27*a* of the shaft displacing member 27 is disposed on the right side of the swing bracket SB. That is, the position in the axial direction, which is the front and rear directions, of the rotation center 27*a* partially overlaps with the position in the axial direction of the front bearing 13*a* of the driven shaft Rja received in the swing bracket SB. Accordingly, in the printer U according to Embodiment 1, compared with the configuration in which the rotation center 27*a* is disposed further inside in the axial direction than the front bearing 13*a*, it is possible to dispose the contact portion 27*c* of the shaft displacing member 27 in the outside in the axial direction of the driven shaft Rja. Therefore, in the printer U according to Embodiment 1, compared with the configuration in which the rotation center 27*a* is disposed not to overlap with the position in the axial direction of the front bearing 13*a*, it is possible to reduce the width of the driven shaft Rja required for arranging the shaft displacing member 27.

As a result, in the printer U according to Embodiment 1, it is possible to reduce the entire length of the driven shaft Rja and thus to reduce the entire size of the belt module BM or the printer U.

Here, when the front end portion of the driven shaft Rja is raised about the rear bearing 13*b* of the driven shaft Rja, it can be raised with a little force by setting a force applying point to the position as apart as possible from the rear bearing 13*b*, that is, the position as close as possible to the front bearing 13*a* by the principle of leverage. That is, it can be raised with a little force by locating the shaft contact surface 27*e* of the contact portion 27*c* as the force applying point at a position close to the front bearing 13*a*.

In Embodiment 1, the rotation center 27*a* is disposed to overlap with the position in the axial direction of the front bearing 13*a* and the shaft contact surface 27*e* is disposed as far as possible in the axial direction of the driven shaft Rja. Therefore, in the printer U according to Embodiment 1, compared with the configuration in which the rotation center 27*a* is disposed not to overlap with the position in the axial direction of the front bearing 13*a*, it is possible to locate the shaft contact surface 27*e* at a position close to the front bearing 13*a*, thereby tilting the driven shaft Rja with a little force.

In the printer U according to Embodiment 1 having the above-mentioned configuration, as shown in FIG. 10, the rotation center 27*a* of the shaft displacing member 27 is supported to move in the vertical direction.

Here, in Embodiment 1, for example, as shown in FIGS. 7 and 8, the distribution of tension of the medium conveying belt B varies in the full color mode and the monochromatic mode and thus fluctuation or irregular rotation of the medium conveying belt B may occur. For example, when the medium conveying belt B is formed of elastic rubber, the peripheral length of the medium conveying belt B may increase or decrease due to environmental change in temperature and humidity or temporal deterioration. In this case, in Embodiment 1, the driven roller Rj suspending the medium conveying belt B in the down direction can move in the vertical direction by the suspending springs SPa and SPa.

Therefore, when the rotation center 27*a* does not move in the vertical direction, the driven shaft Rja may contact and press the upper contact portion 27*f* or the lower contact portion 27*g* by the movement of the driven shaft Rja in the vertical direction and the opposite side of the rotation center 27*a* in the moving direction of the driven shaft Rja may rise up from the center supporting portion 9, thereby tilting the rotation center 27*a*. Accordingly, the rotation locus of the shaft displacing member 27 supported in the state where the rotation center 27*a* is pressed and thus tilted by the driven shaft Rja departs from the right direction which is the tilt direction of the driven shaft Rja. In this case, when the medium conveying belt B is displaced, it is difficult efficiently to transmit the moving force of the members B and 26 as the rotary power of the shaft displacing member 27. As a result, the performance of correcting the displacement of the medium conveying belt B may deteriorate.

However, in the printer U according to Embodiment 1, the rotation center 27*a* is supported to be movable in the vertical direction. Accordingly, when the interlocking body contact portion (27*f*+27*g*) is contacted and pressed by the movement of the driven shaft Rja in the vertical direction, the shaft displacing member 27 can move in the vertical direction by interlocking with the driven shaft Rja.

Accordingly, in the printer U according to Embodiment 1, compared with the configuration in which the rotation center 27*a* does not move in the vertical direction, it is possible to reduce the tilting of the rotation center 27*a* due to the pressing of the driven shaft Rja and thus to smoothly rotate the shaft displacing member 27. As a result, in the printer U according to Embodiment 1, compared with the configuration in which the rotation center 27*a* does not move in the vertical direction, it is possible to reduce the deterioration in performance of correcting the displacement of the medium conveying belt B.

In the printer U according to Embodiment 1 having the above-mentioned configuration, the medium conveying belt B extends in the vertical direction which is the suspending direction of the suspending rollers Rd and Rj. As shown in FIG. 10A, the upper contact portion 27*f* and the lower contact portion 27*g* of the shaft displacing member 27 are disposed with the driven shaft Rja, which contacts with the shaft contact surface 27*e* in the concave portion 27*d* of the shaft displacing member 27, interposed therebetween.

In the printer U according to Embodiment 1, as shown in FIG. 10A, a contact line segment Ls which is the line segment connecting the lower contact portion contact position $P_2$ at which the left end surface 27*h* of the lower contact portion 27*g* comes in contact with the belt displacement detecting member 26 to the upper contact portion contact position $P_1$ at which the left end surface 27*h* of the upper contact portion 27*f* comes in contact with the belt displacement detecting member 26 is set to intersect the driven shaft Rja. That is, the interlocking body contact portion (27*f*+27*g*) of Embodiment 1 contacts with the center portion in the left and right directions of the belt displacement detecting member 26 with the driven shaft Rja interposed therebetween.

In the printer U according to Embodiment 1, the winding angle at which the medium conveying belt B is wound on the driven roller Rj is set to about 180°. Therefore, in Embodiment 1, when the medium conveying belt B is displaced to the front side, the front edge of the medium conveying belt B presses the right end portion, the lower end portion, and the left end portion of the belt displacement detecting member 26 in a U shape.

Therefore, the interlocking body contact portion (27*f*+27*g*) of Embodiment 1 contacts the center portion in the left and right directions which is the center between the right end portion and the left end portion of the belt displacement detecting member 26 pressed by the medium conveying belt B at two positions with the driven shaft Rja interposed therebetween. Accordingly, when the interlocking body contact portion (27*f*+27*g*) contacts the belt displacement detecting member 26 at only one position, for example, at the upper contact portion contact position $P_1$, the belt displacement detecting member 26 pressed by the medium conveying belt B may rotate about the upper contact portion contact position $P_1$ and may be tilted. In this case, it is difficult to move the tilted belt displacement detecting member 26 in the axial direction, thereby making it difficult to allow the displacement of the medium conveying belt B to interlock with the belt displacement detecting member 26. That is, correction of the displacement may be slowed down or precision may be degraded.

However, in the printer U according to Embodiment 1, the contact position of the interlocking body contact portion (27*f*+27*g*) is two positions with the driven shaft Rja interposed therebetween. Accordingly, compared with the configuration in which the contact position of the interlocking body contact portion (27*f*+27*g*) is only one position, it is possible efficiently to transmit the displacement of the medium conveying belt B as the interlocking of the belt displacement detecting member 26 or the rotation of the shaft displacing member 27.

When the winding angle is smaller than 180°, the range in which the medium conveying belt B contacts with the belt displacement detecting member 26 can easily be concentrated on a part and the belt displacement detecting member 26 can easily be tilted. Accordingly, like the interlocking body contact portion (27*f*+27*g*) of Embodiment 1, by bringing them into contact with each other at two positions with the driven shaft Rja interposed therebetween, it is possible to further reduce the tilting of the belt displacement detecting member 26. Therefore, the belt displacement detecting member 26 can easily interlock with the displacement of the medium conveying belt B, thereby improving the response characteristic of the displacement correction by the shaft displacing member 27.

In the printer U according to Embodiment 1, the winding angle at which the medium conveying belt B is wound on the driven roller Rj is set to about 180°. Accordingly, in Embodiment 1, when the medium conveying belt B is displaced to the front side, the front edge of the medium conveying belt B presses the right end portion, the lower end portion, and the left end portion of the belt displacement detecting member 26 in a U shape.

As a result, in the printer U according to Embodiment 1, compared with the configuration in which the winding angle is less than 180°, the range in which the belt displacement detecting member 26 contacts with the front edge of the medium conveying belt B is widened and thus it is possible to easily move to the front side together. That is, the belt displacement detecting member 26 can easily detect the displacement of the medium conveying belt B to the front side. Therefore, in the printer U according to Embodiment 1, compared with the configuration in which the winding angle is less than 180°, it is possible efficiently to transmit the displacement of the medium conveying belt B as the interlocking of the belt displacement detecting member 26 or the rotation of the shaft displacing member 27.

Accordingly, in the printer U according to Embodiment 1, the belt displacement detecting member 26 can efficiently and smoothly move in the axial direction by interlocking with the displacement of the medium conveying belt B. Therefore, even when the rigidity of the medium conveying belt B is small, it is possible to correct the meandering of the medium conveying belt B without gathering wrinkles at the front edge of the medium conveying belt B contacting with the belt displacement detecting member 26. As a result, in the printer U according to Embodiment 1, it is possible to reduce the manufacturing cost of the medium conveying belt B.

Embodiment 2

Embodiment 2 of the invention will be described now. In Embodiment 2, elements corresponding to the elements of Embodiment 1 are referenced by like reference numerals and signs and detailed descriptions thereof are omitted.

Embodiment 2 is different from Embodiment 1 in the following and the other configurations are similar to Embodiment 1.

(Explanation of Belt Module BM in Embodiment 2)

Figure 13B:
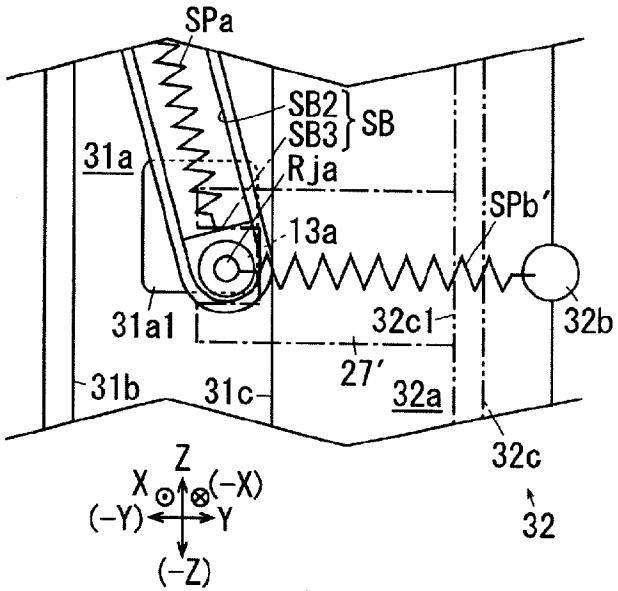
FIGS. 13A and 13B are diagrams illustrating a belt displacement detecting member and a shaft displacing member in Embodiment 2, where
Figure 13A:
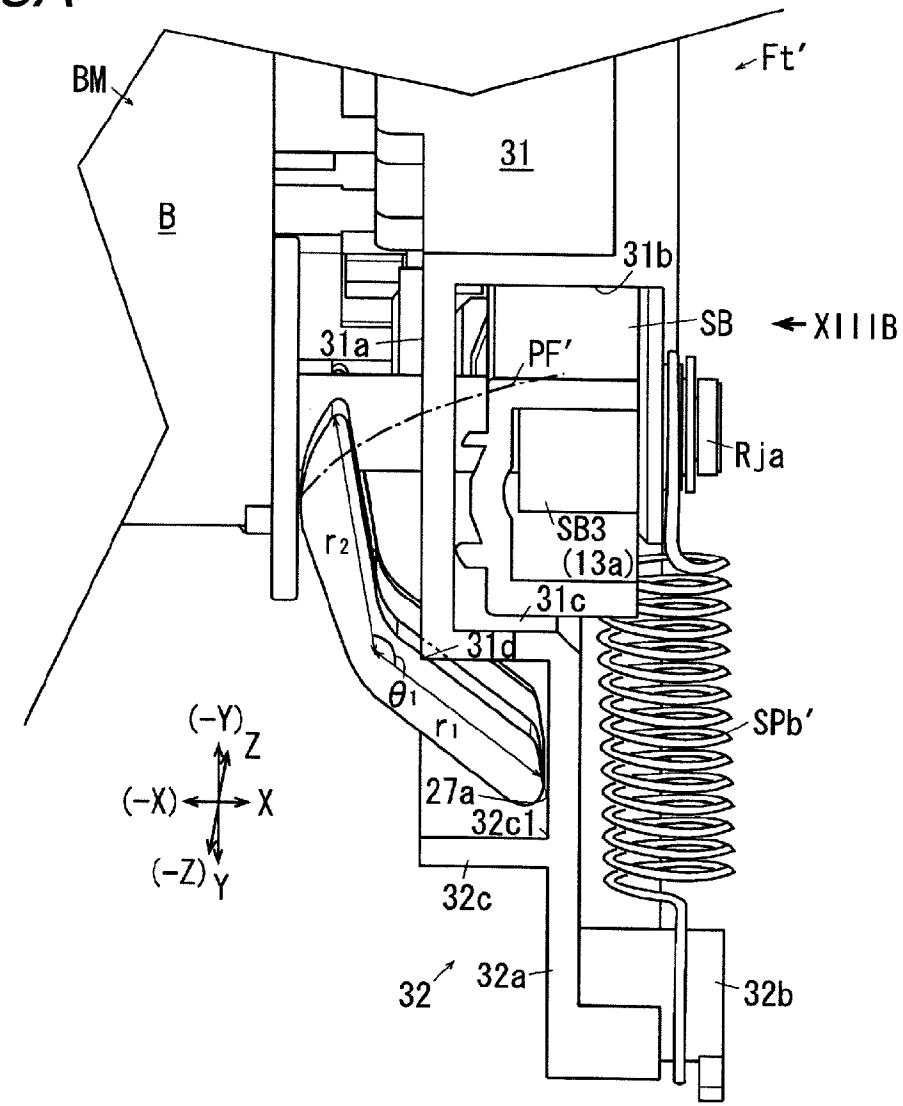

FIGS. 13A and 13B are diagrams illustrating a belt displacement detecting member and a shaft displacing member in Embodiment 2 of the invention, where FIG. 13A is perspective sectional view from a front end of a driven roller to a front bearing, which corresponds to FIG. 10A of Embodiment 1, and FIG. 13B is a diagram illustrating a swing bracket as viewed in the direction of arrow XIIIB of FIG. 13A.

In FIG. 13, a printer U according to Embodiment 2 includes a transfer frame Ft' as an example of a shaft supporting frame and an example of a transfer member supporting frame, instead of the transfer frame Ft of the belt module BM of Embodiment 1.

In FIG. 13B, in the transfer frame Ft' of Embodiment 2, a swing regulating portion 31 as an example of a movement regulating portion having a concave shape which is concave from the outer surface of the front transfer roller supporting plate Ft1 to the inside is formed in the lower end portion of the front transfer roller supporting plate Ft1. The swing bracket SB is received in the swing regulating portion 31 of Embodiment 2. The swing regulating portion 31 of Embodiment 2 includes a plate-like rear end wall 31*a* disposed in the back of the swing bracket SB and perpendicular to the driven shaft Rja. In the rear end wall 31*a* of Embodiment 2, a shaft guiding longitudinal hole 31*a*1 transmitting and guiding the driven shaft Rja in the vertical direction and the horizontal direction is formed at the position corresponding to the driven shaft Rja.

A left end wall 31*b* and a right end wall 31*c* having a plate shape and extending from both ends of the rear end wall 31*a* to the front side are formed in the swing regulating portion 31. A rotation regulating portion 31*d* of Embodiment 2 is constructed by the corner portion 31*d* of the rear end wall 31*a* and the right end wall 31*c*. A center-supporting concave portion 32 having a concave shape which is concave from the inner surface of the front transfer roller supporting plate Ft1 to the outside is formed on the right side as an example of the perpendicular direction of the right end wall 31*c*.

A plate-like front end wall 32*a* extending from the front end of the right end wall 31*c* to the right side is formed in the center-supporting concave portion 32 of Embodiment 2. A protruding portion 32*b* protruding to the front side is formed in the right end portion close to the outer surface of the front end wall 32*a* of Embodiment 2. In Embodiment 2, a driven shaft pressing spring SPb' as an example of a tilt urging member instead of the bracket pressing spring SPb of Embodiment 1 is connected between the protruding portion 32*b* and the driven shaft Rja.

Therefore, in Embodiment 2, the swing bracket SB is urged to the right end wall 31*c* by the driven shaft pressing spring SPb' with the driven shaft Rja and the front bearing 13*a* interposed therebetween. As a result, in Embodiment 2, similarly to Embodiment 1, the front end portion of the driven shaft Rja is set in advance to be displaced to the right relative to the rear end portion.

In Embodiment 2, similarly to Embodiment 1, since the driving shaft Rda of the driving roller Rd is disposed in parallel to the front and rear directions, the medium conveying belt B is set in advance to be displaced to the front side.

(Explanation of Shaft Displacing Member 27' of Embodiment 2)

An inner wall 32*c* extending in the vertical direction is formed in the center portion in the left and right directions of the inner surface of the front end wall 32*a*. In Embodiment 2, a center supporting portion 32*c*1 which is the corner portion of the front end wall 32*a* and the left end portion of the inner wall 32*c* is formed instead of the corner portion 9 of the lower tie bar Fb4 of Embodiment 1. In Embodiment 2, a shaft displacing member 27' instead of the shaft displacing member 27 of Embodiment 1 is supported by the center supporting portion 32*c*1. That is, the shaft displacing member 27' of Embodiment 2 is supported to be rotatable in the state where the position in the front and rear directions of the rotation center 27*a* partially overlaps with the position in the front and rear directions of the front bearing 13*a*.

Here, in the shaft displacing member 27 of Embodiment 1, the shaft displacing line segment $r_0$ shown in FIG. 12 extends in a straight line shape in the extending direction of the extending portion 27*b* from the rotation center 27*a* to the outer end of the contact portion 27*c*. On the contrary, in the shaft displacing member 27' of Embodiment 2, as shown in FIG. 13A, the line segment $r_2$ extending from the connection position of the contact portion 27*c* and the extending portion 27*b* to the outer end portion is displaced to the front side by an angle $\theta_1$ about a first shaft displacing line segment $r_1$ extending from the extending portion 27*b* to the rotation center 27*a*. That is, the shaft displacing member 27' of Embodiment 2 is curved to the front side as it goes from the rotation center 27*a* to the outer end of the contact portion 27*c*.

In Embodiment 2, as indicated by the broken line in FIG. 13A, a contact profile PF' as a history of the contact point of the belt displacement detecting member 26 and the left end surface 27*h* due to the movement of the belt displacement detecting member 26 in the axial direction is set in advance to form an involute curve extending to the center of a circular arc with the curvature of the left end surface 27*h* in the contact profile PF of the circular arc shape of Embodiment 1. The involute curve is a curve drawn by the front end of a string when the string is wound on a fixed axis and the front end of the string is pulled and unwound.

(Operation of Embodiment 2)

In the printer U as an example of the image forming apparatus according to Embodiment 2 having the above-mentioned configuration, as shown in FIG. 13, the center supporting portion 32*c*1 of the center-supporting concave portion 32 supporting the rotation center 27*a* of the shaft displacing member 27' is disposed in the front of the swing regulating portion 31. That is, the position in the axial direction, which is the front and rear directions, of the rotation center 27*a* partially overlaps with the position in the axial direction of the front bearing 13*a* of the driven shaft Rja received in the swing regulating portion 31. Accordingly, in the printer U according to Embodiment 2, compared with the configuration in which the rotation center 27*a* is disposed further inside in the axial direction than the front bearing 13*a*, the contact portion 27*c* of the shaft displacing member 27' can be disposed in the outside in the axial direction of the driven shaft Rja. Therefore, in the printer U according to Embodiment 2, compared with the configuration in which the rotation center 27*a* does not overlap with the position in the axial direction of the front bearing 13*a*, it is possible to reduce the width of the driven shaft Rja required for disposing the shaft displacing member 27'.

As a result, in the printer U according to Embodiment 2, it is possible to reduce the entire length of the driven shaft Rja and thus to reduce the entire size of the belt module BM or the printer U.

In Embodiment 2, similarly to Embodiment 1, the rotation center 27*a* overlaps with the position in the axial direction of the front bearing 13*a* and the shaft contact surface 27*e* is disposed in the outside in the axial direction of the driven shaft Rja as much as possible. Therefore, in the printer U according to Embodiment 2, compared with the configuration in which the rotation center 27*a* does not overlap with the position in the axial direction of the front bearing 13*a*, the shaft contact surface 27*e* can be disposed as close as possible to the front bearing 13*a*, thereby tilting the driven shaft Rja with a little force.

As shown in FIG. 13A, as it goes from the rotation center 27*a* to the outer end of the contact portion 27*c*, the shaft displacing member 27' of Embodiment 2 is curved to the front side. Accordingly, in the printer U according to Embodiment 2, compared with the configuration in which the shaft displacing member 27 is formed in a straight line shape from the rotation center 27*a* to the outer end of the contact portion 27*c* as in Embodiment 1, it is possible to reduce the width of the driven shaft Rja required for arranging the shaft displacing member 27'. As a result, in the printer U according to Embodiment 2, it is possible to reduce the entire length of the driven shaft Rja and to further reduce the entire size of the belt module BM, thereby further reducing the entire size of the printer U.

In the printer U according to Embodiment 2, compared with the configuration in which the portion of the shaft displacing member from the rotation center 27*a* to the outer end of the contact portion 27*c* is formed in a straight line, the shaft contact surface 27*e* can be located at a position close to the front bearing 13*a*, thereby tilting the driven shaft Rja with a less force.

In Embodiment 2, the curvature of the left end surface 27*h* increases as it goes from the outer end of the concave portion 27*d* to the extending portion 27*b*, and the curvature of the left end surface 27*h* is set so that the contact profile PF' shown in FIG. 13A forms an involute curve shape. That is, the shaft displacing member 27' of Embodiment 2 is set so that the movement in the left direction, which is the tilt direction, of the contact point of the belt displacement detecting member 26 and the left end surface 27*h* becomes smaller as it goes to the outside in the axial direction, with the movement of the belt displacement detecting member 26 in the front direction which is the axial direction.

Accordingly, in Embodiment 2, when the medium conveying belt B is displaced and thus the front end portion of the driven shaft Rja moves in the left direction for correcting the displacement, the moving amount of the driven shaft Rja decreases as it gets close to the equilibrium position at which the displacement of the medium conveying belt B is stopped. As a result, in the printer U according to Embodiment 2, compared with the configuration in which the curvature of the left end surface 27*h* is not set so that the contact profile PF' forms the involute curve, it is possible easily to converge the displacement of the medium conveying belt B in the vicinity of the equilibrium position.

In the printer U according to Embodiment 2 having the above-mentioned configuration, the corner portion 31*d* of the right end wall 31*c* and the rear end wall 31*a* of the swing regulating portion 31 is disposed on the left side of the shaft displacing member 27'. Accordingly, when the shaft displacing member 27' rotates to correct the displacement of the medium conveying belt B in the front direction, the rotation of the shaft displacing member 27' is regulated at the maximum rotating position at which the shaft displacing member 27' comes in contact with the corner portion 31*d*.

Therefore, in the printer U according to Embodiment 2, it is possible to regulate the rotating range of the shaft displacing member 27' by the use of the corner portion 31*d*. Accordingly, for example, when the displacement of the medium conveying belt B is corrected, the shaft displacing member 27' can be made not to rotate to an incomplete function area which is a range in which the shaft displacing member 27' exceeds a so-called upper dead point and cannot be returned with the returning of the medium conveying belt B or the driven shaft Rja.

In the printer U according to Embodiment 2, it is possible to set a maximum rotating position and to regulate the excessive rotation of the shaft displacing member 27', by adjusting the position of the corner portion 31*d*.

In addition, the printer U according to Embodiment 2 provides the same operational advantages as the printer U according to Embodiment 1.

Embodiment 3

Embodiment 3 of the invention will be described now. In Embodiment 3, elements corresponding to the elements of Embodiment 2 are referenced by like reference numerals and signs and detailed descriptions thereof are omitted.

Embodiment 3 is different from Embodiment 2 in the following and the other configurations are similar to Embodiment 2.

(Explanation of Belt Module BM in Embodiment 3)

Figure 14A:
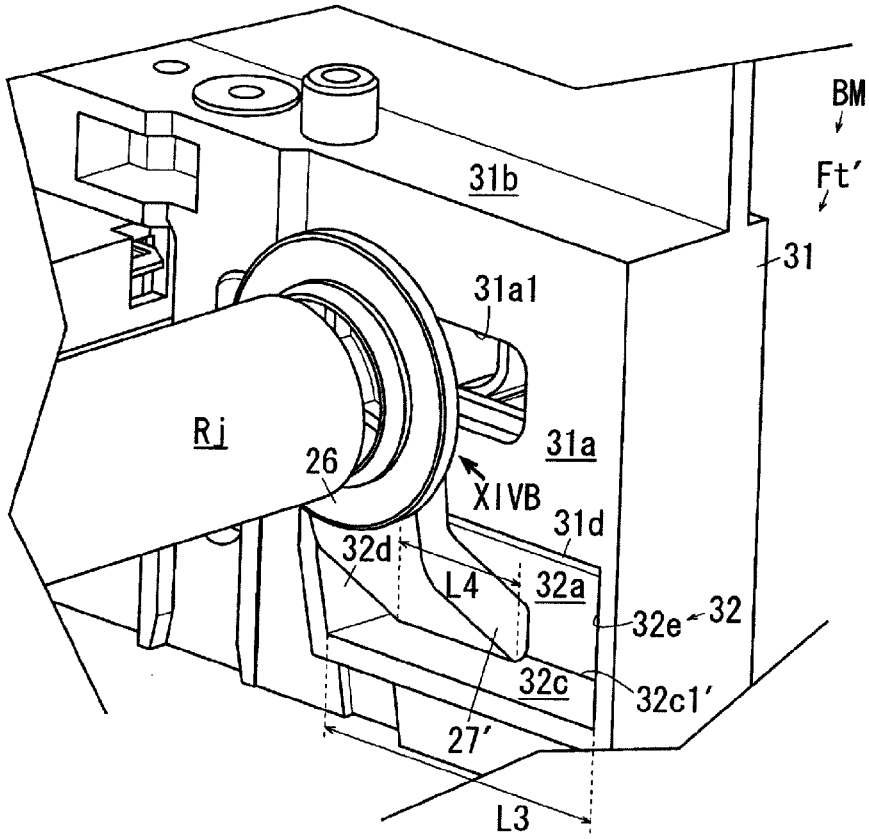
FIGS. 14A and 14B are diagrams illustrating a belt displacement detecting member and a shaft displacing member in Embodiment 3, where
Figure 14B:
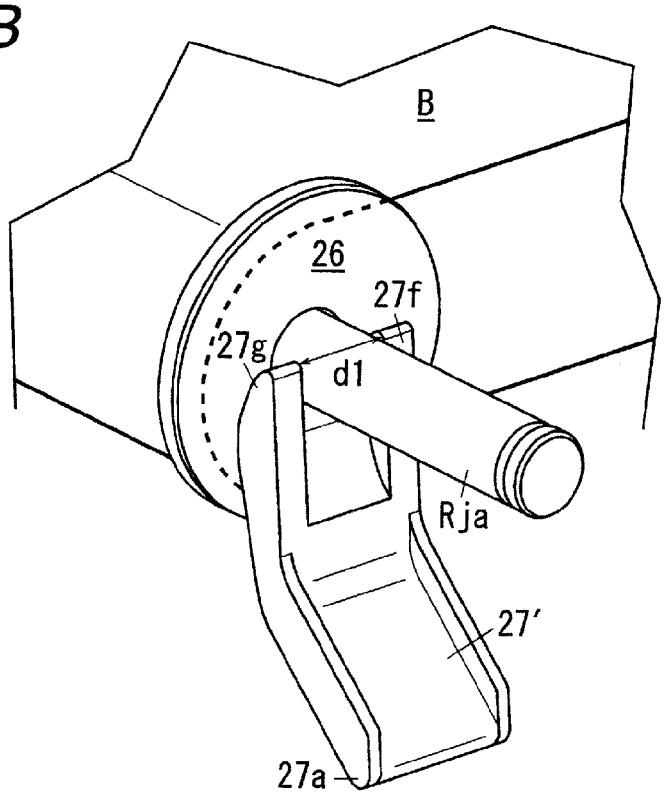

FIGS. 14A and 14B are diagrams illustrating a belt displacement detecting member and a shaft displacing member in Embodiment 3, where FIG. 14A is a perspective sectional view from a front end of a driven roller to a front bearing, which corresponds to FIG. 13A of Embodiment 2, and FIG. 14B is a partially enlarged view of the belt displacement detecting member and the shaft displacing member as viewed in the direction of arrow XIVB of FIG. 14A.

In FIG. 14A, a plate-like upper end wall 32*d* as an example of an upstream movement regulating surface extending backward from the upper end of the front end wall 32*a* and a plate-like lower end wall 32*e* as an example of a downstream movement regulating surface extending backward from the lower end of the front end wall 32*a* are formed in the center-supporting concave portion 32 of Embodiment 3.

The upper end wall 32*d* and the lower end wall 32*e* constitute a movement regulating portion (32*d*+32*e*) of Embodiment 3.

In Embodiment 3, the length L3 between the upper end wall 32*d* and the lower end wall 32*e*, that is, the length L3 in the vertical direction of the center-supporting concave portion 32, is set to be greater than the length L4 in the vertical direction of the rotation center 27*a* of the shaft displacing member 27'. That is, the width in the vertical direction of the center-supporting concave portion 32 is greater than the width in the vertical direction of the shaft displacing member 27'.

As a result, in the center supporting portion 32*c*1' which is the corner portion of the front end wall 32*a* and the inner wall 32*c* of Embodiment 3, the length in the vertical direction is greater than that of the center supporting portion 32*c*1 of Embodiment 2. Accordingly, the rotation center 27*a* contacted and supported by the center supporting portion 32*c*1' is movable in the vertical direction in which the center supporting portion 32*c*1' extends, as shown in FIG. 14B.

In the shaft displacing member 27' of Embodiment 3, the gap dl between the upper contact portion 27*f* and the lower contact portion 27*g*, that is, the gap dl in the vertical direction of the concave portion 27*d*, is set in advance to be equal to the outer diameter of the driven shaft Rja. That is, the driven shaft Rja of Embodiment 3 is disposed between the upper contact portion 27*f* and the lower contact portion 27*g* with no loose gap.

(Operation of Embodiment 3)

In the printer U as an example of the image forming apparatus according to Embodiment 3 having the above-mentioned configuration, as shown in FIG. 14B, the rotation center 27*a* of the shaft displacing member 27' is supported to be movable in the vertical direction. That is, in the printer U according to Embodiment 3, similarly to Embodiment 1, when the interlocking body contact portion (27*f*+27*g*) is contacted and pressed by the movement of the driven shaft Rja in the vertical direction, the shaft displacing member 27' can move in the vertical direction by interlocking with the driven shaft Rja.

Accordingly, in the printer U according to Embodiment 3, compared with the configuration in which the rotation center 27*a* does not move in the vertical direction, it is possible to reduce the displacement of the rotation center 27*a* due to the pressing of the driven shaft Rja and to allow the shaft displacing member 27' to rotate smoothly. As a result, in the printer U according to Embodiment 3, compared with the configuration in which the rotation center 27*a* does not move in the vertical direction, the performance of correcting the displacement of the medium conveying belt B is less degraded.

In Embodiment 3, the gap dl in the vertical direction of the concave portion 27*d* is set to be equal to the outer diameter of the driven shaft Rja. The driven shaft Rja is disposed between the upper contact portion 27*f* and the lower contact portion 27*g* with no loose gap. As a result, in the printer U according to Embodiment 3, it is possible to allow the shaft displacing member 27' to move in the vertical direction by interlocking with the movement of the driven shaft Rja in the suspending direction.

Here, in order to allow the driven shaft Rja not to tilt the rotation center 27*a* by contacting with the upper contact portion 27*f* or the lower contact portion 27*g* in the configuration in which the rotation center 27*a* does not move in the vertical direction, it is necessary to set the gap d1 of the concave portion 27*d* to be sufficiently greater than the moving amount of the driven shaft Rja and it is also necessary to set the length in the vertical direction of the shaft displacing member 27' to be great. Therefore, when the gap d1 is set to be great, it is necessary to enhance the length in the width direction of the belt displacement detecting member 26 or the shaft displacing member 27' so as to secure the contact range of the interlocking body contact portion (27*f*+27*g*) with the belt displacement detecting member 26.

However, in the printer U according to Embodiment 3, the gap d1 is set to be equal to the outer diameter. Accordingly, even when the driven shaft Rja moves in the vertical direction, the contact range of the interlocking body contact portion (27*f*+27*g*) with the belt displacement detecting member 26 transmitting the driven shaft Rja with the driven shaft Rja interposed therebetween can be secured in the vicinity of the driven shaft Rja. As a result, in the printer U according to Embodiment 3, it is possible to reduce the length in the vertical direction of the belt displacement detecting member 26 or the shaft displacing member 27' and thus to reduce the entire size of the belt module BM or the printer U.

In Embodiment 3, the movement in the suspending direction of the rotation center 27*a* is regulated between the upper end wall 32*d* and the lower end wall 32*e*. That is, in Embodiment 3, the shaft displacing member 27' moves in the vertical direction between an intersecting-direction furthest upstream position at which the upper end portion comes in contact with the upper end wall 32*d* and an intersecting-direction furthest downstream position at which the lower end portion comes in contact with the lower end wall 32*e*.

As a result, in the printer U according to Embodiment 3, it is possible to regulate the movement in the vertical direction of the shaft displacing member 27' by the use of the movement regulating portion (32*d*+32*e*) and to prevent the shaft displacing member 27' from moving in the vertical direction and dropping from the center-supporting concave portion 32.

In addition, the printer U according to Embodiment 3 provides the same operational advantages as the printer U according to Embodiment 2.

Modified Embodiments

While the examples of the invention have been described in detail, the invention is not limited to the examples, but may be modified in various forms without departing from the spirit and scope of the invention described in the appended claims. Modified Embodiments (H01) to (H011) of the invention will be described below.

(H01) Although a printer is exemplified as the image forming apparatus in the above-mentioned examples, the invention is not limited to the examples but may be applied to a FAX or a copier or a multi-function machine having all the functions thereof or plural functions. The invention is not limited to the electrophotographic image forming apparatus, but the configurations described in the examples may be applied to a part of a medium conveying member in a so-called ink jet type image forming apparatus.

(H02) Although the configuration in which the black photoconductor Pk is arranged at the top end has been exemplified in the above-mentioned examples, the invention is not limited to the configuration, but the arrangement position may be changed depending on the configuration or design.

(H03) Although the movement of the medium conveying belt B has been controlled by the use of the eccentric cam HC and the transfer frame pressing spring SPc in the above-mentioned examples, the invention is not limited to this configuration, but may employ any configuration as long as the medium conveying belt B can move. For example, a so-called solenoid may be employed instead of the eccentric cam HC, or the weight of the transfer frame Ft may be used by adjusting the center position of the transfer frame Ft instead of the transfer frame pressing spring SP.

(H04) Although the four-color image forming apparatus of Y, M, C, and K has been exemplified in the above-mentioned examples, the invention is not limited to four colors, but may be applied to image forming apparatuses of three or less or five or more colors.

(H05) Although the medium conveying belt B has been exemplified as the endless belt-shaped member in the above-mentioned examples, the invention is not limited to this configuration, but may employ an endless belt-shaped member such as an intermediate transfer belt as an example of an intermediate transfer body with and from which a belt cleaner or a secondary transfer member comes in contact or moves apart or a photoconductor belt as an example of the image carrier. That is, it is possible to construct an intermediate transfer device, a transfer device, and an image recording apparatus having the belt module BM as an example of the displacement correcting device according to the invention.

Figure 15:
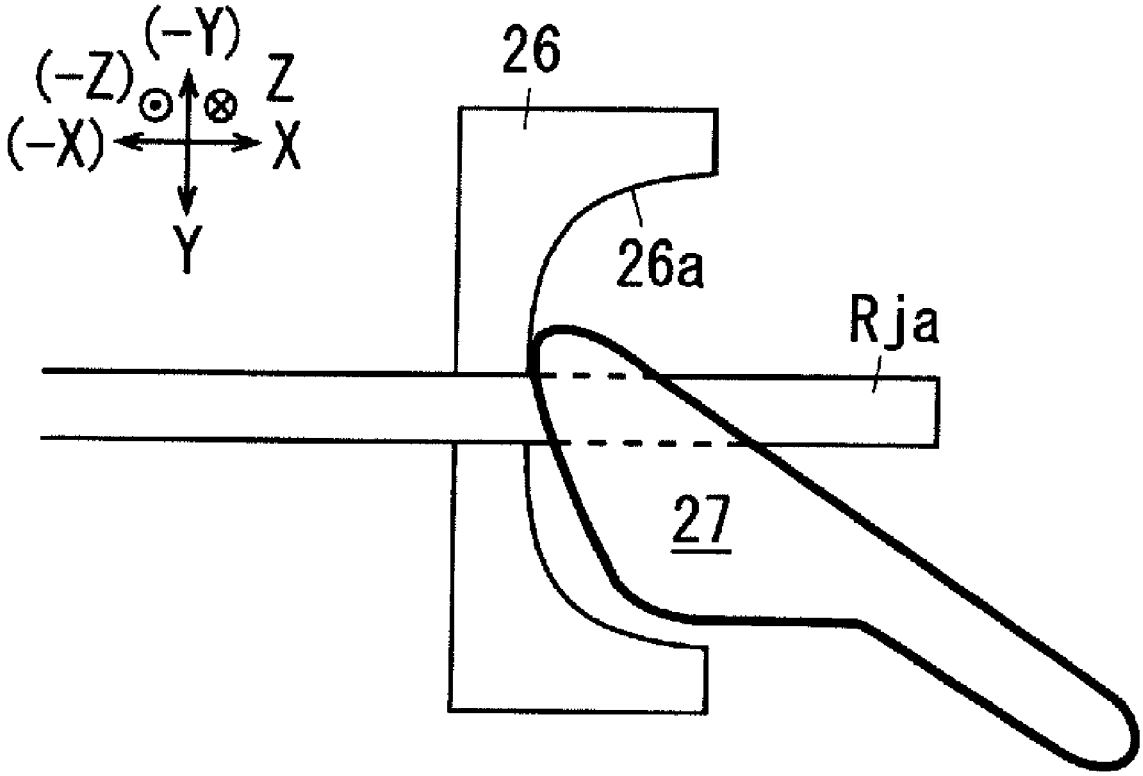
FIG. 15 is a partially enlarged view of a belt displacement detecting member according to a modified example.

FIG. 15 is a partially enlarged view of a modified example of the belt displacement detecting member.

(H06) In Embodiment 1, the curvature of the left end surface 27*h* is set so that the contact profile PF forms a circular arc and the contact profile PF' of Embodiment 2 forms an involute curve extending to the center of the circular arc in the contact profile PF having the circular arc shape of Embodiment 1 so as easily to converge the displacement of the medium conveying belt B in the vicinity of the equilibrium position, but the invention is not limited to this configuration. For example, by setting the curvature of the left end surface 27*h* so that the contact profile forms a cycloid curve extending to the center of the circular arc in the contact profile PF having the circular arc of Embodiment 1, the displacement of the medium conveying belt B may be easily converged in the vicinity of the equilibrium position. As shown in FIG. 15, by setting the curvature of the right end surface 26*a* which is the contact surface with the belt displacement detecting member 26 so as to increase as it goes from the driven shaft Rja as the center of a disc to the outer periphery in addition to the curvature of the left end surface 27*h*, the same operational advantages as the configurations of the above-mentioned examples can be obtained.

(H07) In the above-mentioned examples, since the belt module BM is arranged in the vertical direction, the pressing spring SPb or SPb' urges the swing bracket SB to be displaced. However, for example, by arranging the belt module BM in the horizontal direction, the swing bracket SB may be displaced with its weight, whereby the pressing spring SPb or SPb' may be omitted.

(H08) In the above-mentioned examples, since the medium conveying belt B is set to be displaced only to the front side, the shaft displacing member 27 or 27' is disposed only in the front end portion of the driven shaft Rja, but the invention is not limited to this configuration. For example, the swing bracket SB or the shaft displacing member 27 or 27' may be disposed on both end portions of the driven shaft Rja so as to cope with the displacement of both sides in the width direction of the medium conveying belt B.

(H09) In the above-mentioned examples, the shaft displacing member 27 or 27' is arranged to the right side of the driven shaft Rja to correspond to the driven roller Rj tilted to the right side, but the invention is not limited to this configuration. For example, when one end portion of the driven shaft Rja is set to be tilted about the other end portion, the shaft displacing member 27 or 27' may be set so that one end portion of the driven shaft Rja is displaced in the opposite direction of the tilt direction set in the other end portion.

Figure 16A:
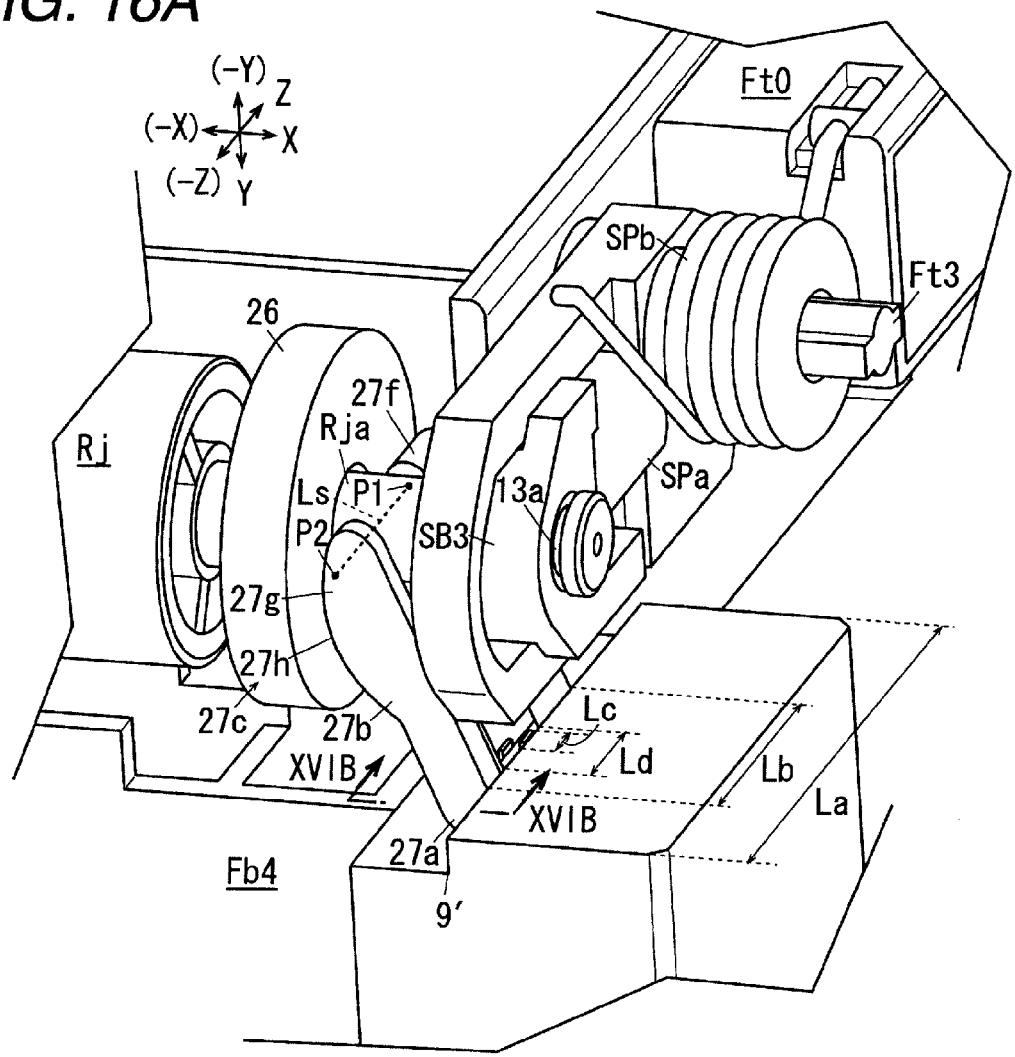
FIGS. 16A and 16B are perspective enlarged views of a belt displacement detecting member and a shaft displacing member in a modified example, which corresponds to FIG. 10 of Embodiment 1, where
Figure 16B:
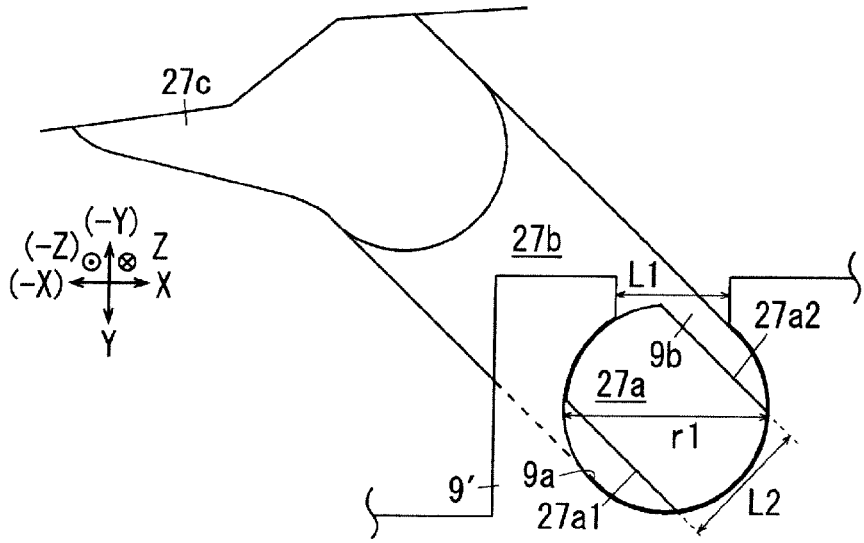

FIGS. 16A and 16B are perspective enlarged views of a belt displacement detecting member and a shaft displacing member in a modified example, which corresponds to FIG. 10 of Embodiment 1, where FIG. 16A is a perspective enlarged view from a front end of a driven roller to a front bearing and FIG. 16B is a sectional view taken along line XVIB-XVIB of FIG. 16A.

(H010) In Embodiment 1, the rotation center 27*a* of the shaft displacing member 27 is supported by the corner portion 9, but the invention is not limited to this configuration. For example, as shown in FIG. 16, the rotation center may be supported by a groove portion 9' as an example of the center mounting portion. The groove portion 9' shown in FIG. 16 includes an inner peripheral surface 9*a* of a shape covering the outer peripheral surface of a cylinder extending in the vertical direction and a cut-out insertion portion 9*b* as an opening formed on the left side of the inner peripheral surface 9*a*. Here, in the shaft displacing member 27 and the groove portion 9', as shown in FIG. 16B, the opening width L1 of the cut-out insertion portion 9*b* in the front and rear directions is set to be smaller than the inner diameter r1 of the inner peripheral surface 9*a* which is the maximum width of the inner peripheral surface 9*a* in the front and rear directions, the diameter of the rotation center 27*a* is set to be equal to the inner diameter r1 of the inner peripheral surface 9*a*, and the cut distance L2 which is the distance between the cut surfaces 27*a*1 and 27*a*2 is set to be smaller than the opening width L1 of the cut-out insertion portion 9*b* of the groove portion 9', whereby the rotation center 27*a* can be inserted into the cut-out insertion portion 9*b* from the left side of the groove portion 9' in the state where the posture of the shaft displacing member 27 is fitted so that the cut distance L2 is fitted to the opening width L1. In the inserted state, the rotation center is rotatably supported by the inner peripheral surface 9*a*. That is, the rotation center 27*a* can be supported to be rotatable about and detachable from the groove portion 9'. As shown in FIG. 16A, by setting the groove portion 9' so that the length Lc in the vertical direction of the cut-out insertion portion 9*b* is smaller than the length Ld in the vertical direction of the extending portions 27*b* extending from both ends in the vertical direction of the rotation center 27*a*, the rotation center 27*a* can be supported to be movable in the vertical direction which is the suspending direction.

(H011) Like the belt modules BM according to Embodiments 1 to 3, it is preferable that the mechanism for detecting the meandering of the medium conveying belt B using the belt displacement detecting member 26 and the interlocking body contact portion (27*f*+27*g*) and the mechanism for correcting the meandering of the medium conveying belt B by pressing the driven shaft Rja using the rotation center 27*a* and the shaft contact surface 27*e* are formed as a body, but the invention is not limited to this configuration. For example, the displacement of the medium conveying belt B may be corrected using a belt displacement detecting sensor as an example of the movement detecting member detecting the moving amount Lx of the medium conveying belt B, the shaft displacing member 27 including the rotation center 27*a* and the shaft contact surface 27*e*, and rotation control means for rotating the rotation center 27*a* on the basis of Expressions (1-1) and (1-2), instead of the elements 26 and (27*f*+27*g*). That is, even when the mechanism for detecting the meandering of the medium conveying belt B and the mechanism for correcting the meandering of the medium conveying belt B are formed individually, it is possible to obtain the operational advantage of the invention.

(H012) Like the belt modules BM according to Embodiments 1 and 3, it is preferable that the mechanism for sensing the meandering of the medium conveying belt B using the belt inclination sensing member 26 and the interlocking body contact portion (27*f*+27*g*), the mechanism for correcting the meandering of the medium conveying belt B by pressing the driven shaft Rja using the rotation center 27*a* and the shaft contact surface 27*e*, and the mechanism for allowing the rotation center 27*a* to interlock with the movement of the medium conveying belt B in the suspending direction using the driven shaft Rja and the interlocking body contact portion (27*f*+27*g*) are formed integrally in a body, but the invention is not limited to this configuration. For example, the inclination of the medium conveying belt B may be corrected using a belt inclination sensing sensor as an example of the movement sensing member sensing the moving amount Lx of the medium conveying belt B, the shaft displacing member 27 including the rotation center 27*a* and the shaft contact surface 27*e*, and rotation control means for rotating the rotation center 27*a* on the basis of Expressions (1-1) and (1-2), instead of the elements 26 and (27*f*+27*g*). In addition, the rotation center 27*a* may be made to interlock with the movement of the medium conveying belt B in the suspending direction using the interlocking body allowing the rotation center 27*a* to interlock with the movement of the medium conveying belt B in the suspending direction. That is, even when the mechanism for sensing the meandering of the medium conveying belt B, the mechanism for correcting the meandering of the medium conveying belt B, and the mechanism for allowing the rotation center 27*a* to interlock with the movement of the medium conveying belt B in the suspending direction are formed individually, it is possible to obtain the operational advantage of the invention.

What is claimed is:

1. An displacement correcting device comprising:

an endless belt-shaped member;

a rotation supporting member that includes a rotation shaft the axial direction of which is parallel to a width direction of the endless belt-shaped member and rotates to support the endless belt-shaped member;

a rotation shaft supporting body that includes a one-end supporting portion rotatably supporting one end of the rotation shaft and an opposite-end supporting portion rotatably supporting the other end of the rotation shaft;

a shaft supporting frame that supports the one-end supporting portion movably relative to the opposite-end supporting portion and supports the one end of the rotation shaft so that the one end of the rotation shaft can be tilted with respect to the other end of the rotation shaft;

a movement detecting member that detects movement of the endless belt-shaped member to the one end of the rotation shaft; and a shaft displacing member that includes a rotation center which is disposed at a position displaced from the rotation shaft and closer to the one end of the rotation shaft than the rotation shaft supporting body and which intersects an axial direction of the rotation shaft, and that further includes a rotation shaft contact portion which contacts with the one end of the rotation shaft, wherein the movement detecting member detects the movement of the endless belt-shaped member to the one end of the rotation shaft, the rotation shaft contact portion rotates about the rotation center to move the one end of the rotation shaft relative to the other end of the rotation shaft so that the rotation shaft is tilted in a tilt direction in which the endless belt-shaped member moves to the other end of the rotation shaft.

2. The displacement correcting device according to claim 1, wherein the movement detecting member includes an interlocking body which is supported to move in the axial direction by the one end of the rotation shaft and which can contact with a widthwise edge of the endless belt-shaped member, the shaft displacing member includes an interlocking body contact portion which can contact with the interlocking member and which can move integrally with the rotation shaft contact portion, and when the interlocking body is pressed by the widthwise edge of the endless belt-shaped member moving to the one end of the rotation shaft, the interlocking body contact portion and the rotation shaft contact portion rotate about the rotation center so that the rotation shaft contact portion tilts the rotation shaft in the tilt direction.

3. The displacement correcting device according to claim 2, wherein the rotation shaft contact portion is extended from the rotation center to the rotation supporting member, and the interlocking body contact portion is extended from the rotation center to a side of the interlocking body.

4. The displacement correcting device according to claim 1, further comprising a center-supporting concave portion having a concave shape which is formed to be concave from the other end to the one end in the axial direction, the center-supporting concave portion rotatably supporting the rotation center of the shaft displacing member at a position displaced from the rotation shaft in a direction intersecting the axial direction and closer to the one end in the axial direction than the rotation shaft supporting body in the concave shape.

5. The displacement correcting device according to claim 4, further comprising a rotation regulating portion which is disposed at a position of the center-supporting concave portion close to the shaft supporting frame and has a contact surface with the shaft displacing member, and which contacts with the shaft displacing member so as to regulate a rotation of the shaft displacing member when the shaft displacing member rotates up to a predetermined maximum rotating position about the rotation center.

6. The displacement correcting device according to claim 1, wherein the shaft displacing member is curved toward the one end of the rotation shaft as the shaft displacing member goes to the rotation shaft contact portion from the rotation center.

7. The displacement correcting device according to claim 1, wherein the shaft supporting frame supports the one-end supporting portion and the opposite-end supporting portion movably in a suspending direction in which the rotation supporting member applies a tension to the endless belt-shaped member;

the rotation center is extended in an intersecting direction including a directional component in the suspending direction and intersecting the axial direction, and the displacement correcting device further comprises a center supporting portion that supports the rotation center movably in the intersecting direction.

8. The displacement correcting device according to claim 7, wherein the movement detecting member includes an interlocking body which is supported to move in the axial direction by the one end of the rotation shaft and which can contact with a widthwise edge of the endless belt-shaped member, the shaft displacing member includes an interlocking body contact portion which can contact with the interlocking member and which can move integrally with the rotation shaft contact portion, and when the interlocking body is pressed by the widthwise edge of the endless belt-shaped member moving to the one end of the rotation shaft, the interlocking body contact portion and the rotation shaft contact portion rotate about the rotation center so that the rotation shaft contact portion tilts the rotation shaft in the tilt direction.

9. The displacement correcting device according to claim 8, wherein the rotation shaft contact portion is extended from the rotation center to the rotation supporting member, and the interlocking body contact portion is extended from the rotation center to a side of the interlocking body.

10. The displacement correcting device according to claim 8, wherein the interlocking contact portion includes an upstream contact portion contacting with the interlocking body at an upstream side in the intersecting direction and a downstream contact portion contacting with the interlocking body at a downstream side in the intersecting direction and at the opposite side of the upstream contact portion about the rotation shaft.

11. The displacement correcting device according to claim 7, further comprising:

a center-supporting concave portion having a concave shape which is formed to be concave from the other end to the one end in the axial direction, the center-supporting concave portion rotatably supporting the rotation center of the shaft displacing member at a position displaced from the rotation shaft in a direction intersecting the axial direction and closer to the one end in the axial direction than the rotation shaft supporting body in the concave shape; and a movement regulating portion having an upstream end surface and a downstream end surface of the center-supporting concave portion in the intersecting direction, wherein the upstream end surface includes an upstream movement regulating surface coming in contact with the shaft displacing member to regulate the shaft displacing member when the rotation center moves to a predetermined furthest upstream position in the intersecting direction, and the downstream end surface includes a downstream movement regulating surface coming in contact with the shaft displacing member to regulate the movement of the shaft displacing member when the rotation center moves to a predetermined furthest downstream position in the intersecting direction.

12. The displacement correcting device according to claim 7, wherein the rotation center is capable of moving in the intersecting direction.

13. An intermediate transfer device comprising:

an intermediate transfer body of an endless belt-shaped member the outer surface of which passes through an opposed area of an image carrier carrying an image in a rotating direction thereof;

an intermediate transfer member disposed in an intermediate transfer area located on a rear side of the endless belt-shaped member and opposed to the image carrier with the endless belt-shaped member interposed therebetween and serving to transfer the image on the image carrier to the outer surface of the endless belt-shaped member; and a displacement correcting device according to claim 1 and serving to correct displacement of the intermediate transfer body.

14. A transfer device comprising:

an intermediate transfer device according to claim 13 in which the image is transferred to the outer surface of the endless belt-shaped intermediate transfer body; and a final transfer member transferring the image onto a final transfer body.

15. An image forming apparatus comprising:

an image carrier having a latent image formed on a surface thereof;

a developing device developing the latent image on the surface of the image carrier into an image as a visible image;

a transfer device according to claim 14 serving to transfer the image on the surface of the image carrier to a medium; and a fixing device fixing the image on a surface of the medium.

* * * * *